US012528642B2

(12) United States Patent
Viano et al.

(10) Patent No.: US 12,528,642 B2
(45) Date of Patent: Jan. 20, 2026

(54) SLIP LINKAGES FOR RETRACTABLE CONTAINER COVERS

(71) Applicant: JDS Industries, Denver, CO (US)

(72) Inventors: Jacob H. Viano, Denver, CO (US); Conard W. Kern, Denver, CO (US)

(73) Assignee: JDS Industries, Denver, CO (US)

( * ) Notice: Subject to any disclaimer, the term of this patent is extended or adjusted under 35 U.S.C. 154(b) by 3 days.

(21) Appl. No.: 18/316,129

(22) Filed: May 11, 2023

(65) Prior Publication Data

US 2023/0365324 A1 Nov. 16, 2023

Related U.S. Application Data

(60) Provisional application No. 63/342,029, filed on May 13, 2022.

(51) Int. Cl.
*B65D 88/12* (2006.01)

(52) U.S. Cl.
CPC ..... *B65D 88/125* (2013.01); *B65D 88/127* (2013.01)

(58) Field of Classification Search
CPC ..... B65D 88/125; B65D 88/127; B65D 90/0006; B65D 90/008; B65D 88/02; B65D 88/022; B65D 88/12; B65D 88/122; B65D 88/123; B65D 88/1612
See application file for complete search history.

(56) References Cited

U.S. PATENT DOCUMENTS 4,138,154 A 2/1979 McKeon
4,428,491 A 1/1984 Mittelmann
4,565,231 A * 1/1986 Moessner ..... E06B 9/08 160/133
4,786,099 A 11/1988 Mount
4,889,381 A 12/1989 Tamblyn
4,909,563 A 3/1990 Smith
4,947,937 A 8/1990 Searer
4,995,663 A 2/1991 Weaver
5,040,843 A 8/1991 Russell
5,165,461 A 11/1992 Haddad, Jr.
5,682,937 A * 11/1997 Decrane ..... E06B 9/58 160/241
6,766,845 B2 * 7/2004 Rejc ..... E06B 9/15 160/133
7,913,739 B2 * 3/2011 Rejc ..... E06B 9/62 160/133
8,579,151 B2 11/2013 Kodama
8,899,297 B2 * 12/2014 Mazej ..... E06B 9/174 160/310
2006/0231215 A1 * 10/2006 Loo ..... A62C 2/24 160/133

(Continued)

FOREIGN PATENT DOCUMENTS

CN 204591076 U 4/2015

*Primary Examiner* — Kareen K Thomas

(74) *Attorney, Agent, or Firm* — Pierson Ferdinand LLP; Daniel Rose

(57) ABSTRACT

Implementations of slip linkages are shown and described, including two-part and three-part implementations. Implementations of these linkages provide connections between elements with at least one translation degree of freedom, sometimes referred to as a prismatic joint or slider or telescopic joint. Such implementations may be utilized in connection with covers for roll-off containers or dumpsters, such as retractable container covers.

17 Claims, 27 Drawing Sheets

(56) References Cited

U.S. PATENT DOCUMENTS

| | | | | |
|---|---|---|---|---|
| 2007/0000759 | A1 | 1/2007 | Knapen | |
| 2008/0295411 | A1* | 12/2008 | Rejc | E06B 9/08 49/445 |
| 2019/0263228 | A1 | 8/2019 | Zeng | |

* cited by examiner

SLIP LINKAGES FOR RETRACTABLE CONTAINER COVERS

RELATED APPLICATIONS

The present application claims the benefit of and priority to U.S. Provisional Patent Application No. 63/342,029, entitled "Slip Linkages," filed May 13, 2022, the entirety of which is incorporated by reference herein.

BACKGROUND

Roll-off containers, sometimes referred to as dumpsters, movable containers, collection containers, trash receptacles, skips, or by similar terms, are popular devices for collecting large objects or refuse in bulk quantities at a various locations. In many cases, a roll-off container may be rented by an individual, a construction company, or some other entity in connection with a temporary construction project, the renovation of a building, or some other project, for example. The roll-off container may be rented to said individual, construction company, or other entity by a refuse management company, where the rental agreement often includes a promise on the part of the renter to pay for refuse collection services in part according to the weight of the contents deposited into the roll-off container. Often, the cost to rent a roll-off container is high, and such costs become acutely magnified when the roll-off container is filled with heavy refuse or other objects.

Because the cost to rent and fill a roll-off container is high, third parties may be incentivized to dispose of their own refuse in a roll-off container rented by another so as to avoid bearing the cost of disposing of the refuse themselves. Relatedly, roll-off container renters may be incentivized to keep others from filling their rented container in hopes of avoiding further unnecessary expense. Furthermore, roll-off containers with an exposed cavity may allow for contents to blow or fly out of the roll-off container as the roll-off container is transported. Unfortunately, current roll-off containers do not include a container cover or other means to securely exclude third parties from utilizing a roll-off container rented by another, and thus do not provide a secure and convenient means of covering and locking the roll-off container when the container is not in use.

SUMMARY

Implementations of slip linkages are shown and described, including two-part and three-part implementations. Implementations of these linkages provide connections between elements with at least one translation degree of freedom, sometimes referred to as a prismatic joint or slider or telescopic joint. Such implementations may be utilized in connection with covers for roll-off containers or dumpsters, such as retractable container covers.

The invention is capable of other embodiments and of being carried out in various ways. Alternative exemplary embodiments relate to other features and combinations of features as may be recited herein.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures.

It should also be understood that the terminology is for the purpose of description only and should not be regarded as limiting.

Referring to the figures generally, the various exemplary embodiments disclosed herein relate to systems, apparatuses, and methods for a roll-off container cover. The roll-off container cover may be adapted to securely cover a cavity of a roll-off refuse container in order to selectively restrict access to the roll-off container cover. According to one embodiment, the roll-off container cover may include a retractable cover that can extend over the top of a roll-off refuse container to enclose the roll-off container cavity to secure the container cavity in order to prevent unauthorized access, to secure the contents of the container pursuant to various local regulations while the container is transported, etc.

Figure 1:
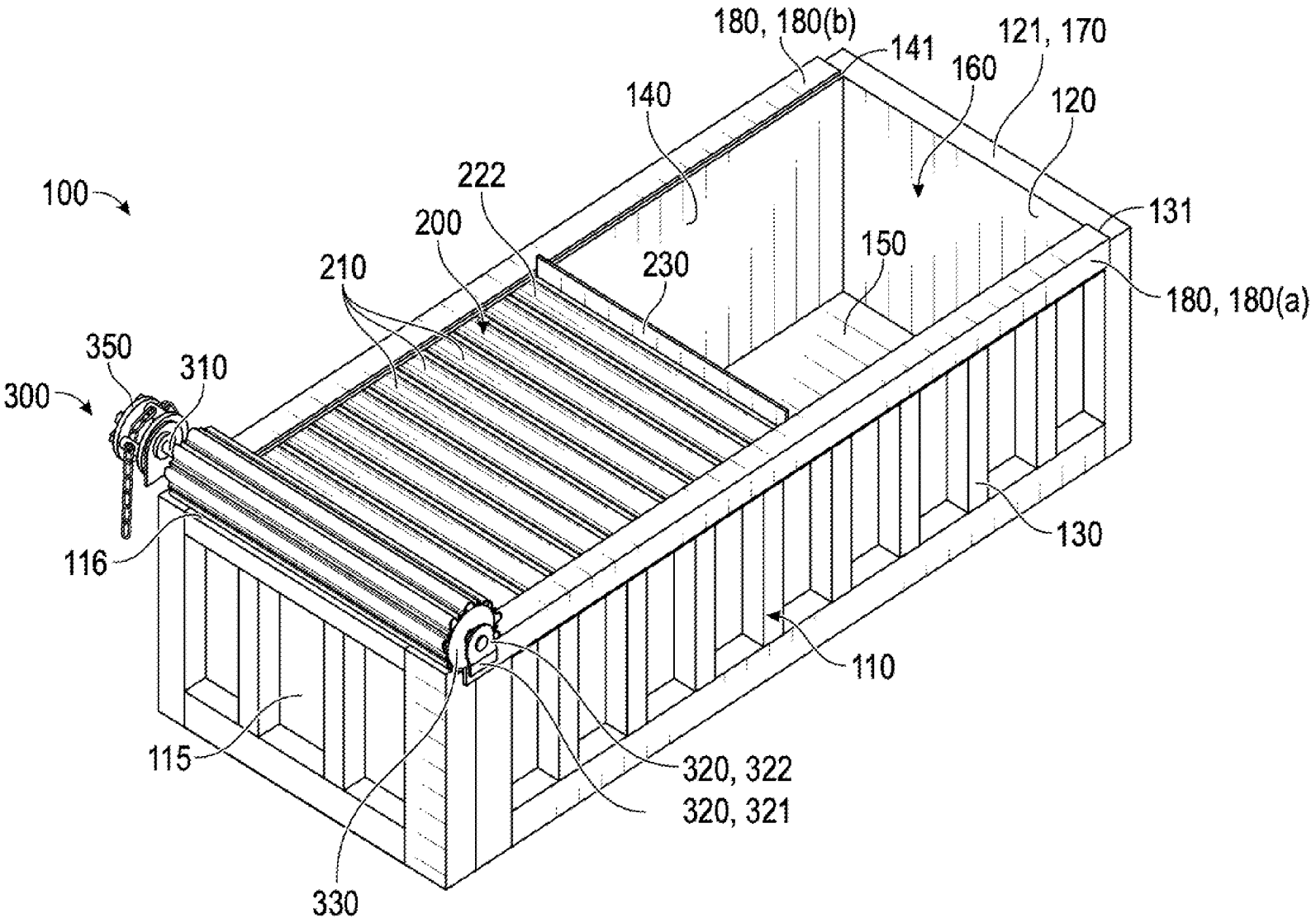
FIG. 1 is a perspective view of a roll-off container cover, according to an exemplary embodiment.

Turning now to FIG. 1, a roll-off container cover 100 is shown. The roll-off container cover 100 may include a roll-off container 110, a cover 200, and a cover actuation assembly 300. The roll-off container 110 may be a commercially-available roll-off container of various sizes, such as a 10-yard, 20-yard, or 40-yard container, etc. More particularly, the roll-off container 110 may have a generally parallepiped shape with a length, a width, and a height. A cavity 160 of the roll-off container is defined by a front wall 115, a back wall 120, a first side wall 130, a second side wall 140, and a bottom 150. Each of the front wall 115, back wall 120, first side wall 130, and the second side wall 140 may be coupled to and extend perpendicularly from the bottom 150 of the roll-off container 110. Likewise, each of the front wall 115, back wall 120, first side wall 130, and the second side wall 140 may define a top 170 of the roll-off container 110. The front wall 115 includes a top rail 116, and the back wall 120 includes a top rail 121. The first side wall 130 and second side wall 140 include a top rail 131, 141, respectively. The top rails 116, 121, 131, and 141 collectively define the top 170 of the roll-off container 110, which is oriented to be substantially parallel to the bottom 150 and substantially perpendicular to the walls 115, 120, 130, 140.

The roll-off container 110 may further include a cover track assembly 180. In one embodiment, the roll-off container 110 includes a cover track assembly 180 that includes a first cover track 180(*a*) and a second cover track 180(*b*), where the first cover track 180(*a*) is coupled to the first side wall 130 and the second cover track 180(*b*) is coupled to the second side wall 140. Furthermore, the first cover track 180(*a*) and the second cover track 180(*b*) may be coupled to the top rails 131, 141 of the first side wall 130 and second side wall 140, respectively. The first and second cover tracks 180(*a*), 180(*b*) may be coupled to the top rails 131, 141 and may extend above the top 170 of the roll-off container 110 such that a cover envelope 185 is defined by the space between the each of the cover tracks 180(*a*), 180(*b*) and the top 170. In one embodiment, a first portion 181 of each cover track 180(*a*), 180(*b*) may be coupled to the top rails 131, 141, while a second portion 182 may be spaced apart from the top 170, as is shown in further detail in FIG. 7A. Specifically, the second portion 182 may be spaced a distance 182(*a*) from the top 170, where the distance 182(*a*) is greater than a thickness of the cover 200, as described further below with reference to FIGS. 7A-7C. The cover envelope 185 is thus defined by the distance between the second portion 182 and the top 170 and is sufficiently large to receive the cover 200 and other elements, according to one embodiment. Additional embodiments are discussed with reference to FIGS. 7B and 7C.

In the various embodiments, the cover track assembly 180 is configured to receive the cover 200 in order to facilitate the movement of the cover 200 within the cover track assembly 180 (i.e. over the top 170 of the roll-off container 110, but within the cover track assembly 180) in a cover translation direction 188 along the length of the roll-off container 110. When the cover 200 translates along the top 170 within the cover track assembly 180, the cover 200 serves to enclose the cavity 160 of the roll-off container 110 such that the contents of (or availability of or access to) the open space within the roll-off container 110 (e.g., refuse contained within the cavity 160) are no longer accessible from an exterior of the roll-off container 110.

Figure 2:
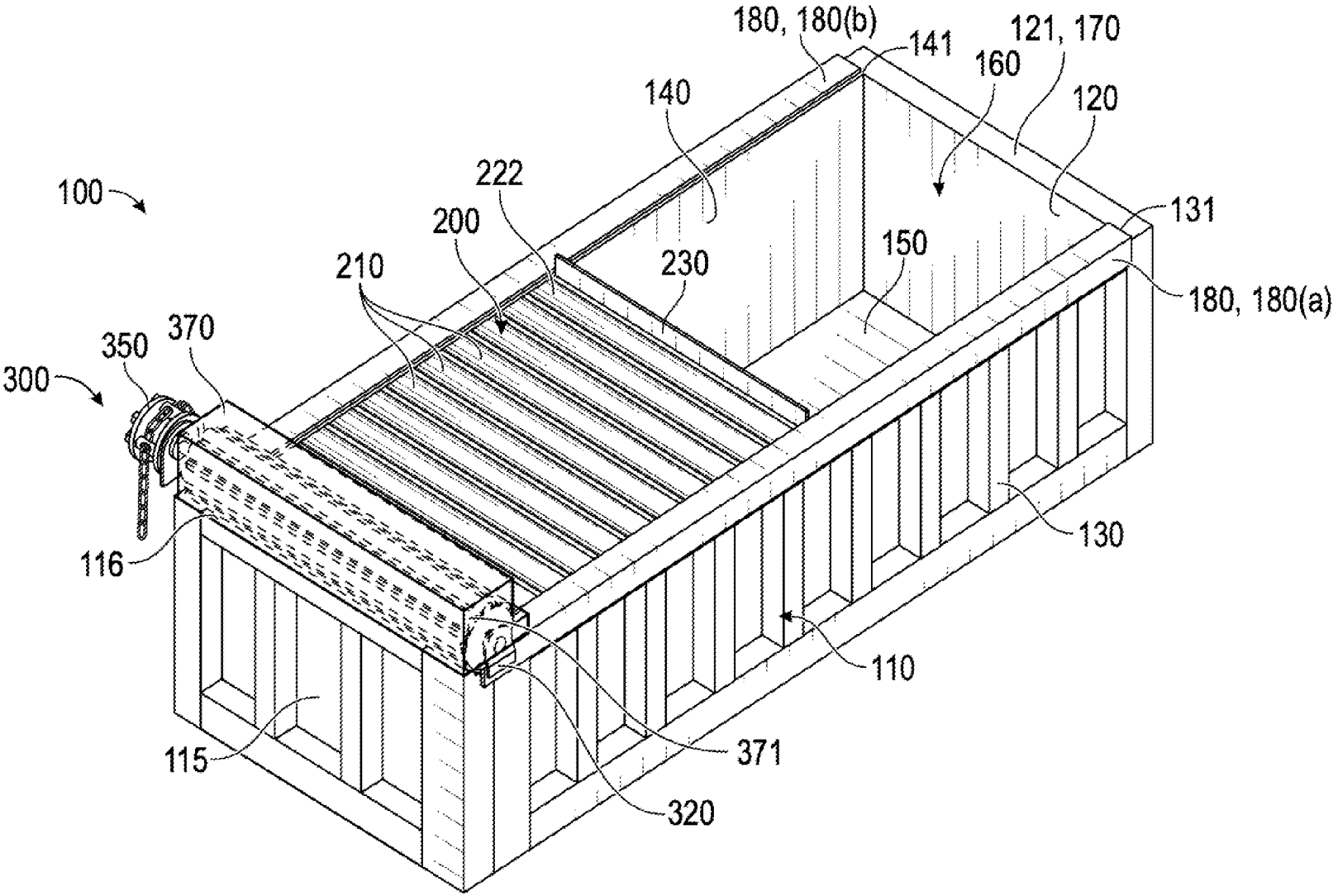
FIG. 2 is a perspective view of a roll-off container cover, according to an exemplary embodiment.

The cover track assembly 180 and the various components contained therein (i.e. the first cover track 180(*a*) or the second cover track 180(*b*)) may be fixedly or removably coupled to the roll-off container 110, such as by welding or by some other fastening means. In one embodiment, two cover tracks 180(*a*), 180(*b*) are welded to the top rails 131 and 141 of the roll-off container 110, as is shown in FIGS. 1 and 2. In another embodiment, two cover tracks 180(*a*), 180(*b*) are removably coupled to the top rails 131 and 141 of the roll-off container such that the cover tracks 180(*a*), 180(*b*) may be selectively removed. The removable coupling of the cover tracks 180(*a*), 180(*b*) to the top rails 131, 141 may be achieved by various coupling means, including fastening by shank-style fasteners or by coupling using a latching mechanism, etc. In such embodiments, the cover tracks 180(*a*), 180(*b*) may be removable in order to facilitate maintenance of the cover tracks 180(*a*), 180(*b*) and any associated components, for example.

Referring now to FIGS. 1, 2, 4A-4B, 7A-7C, and 8A-8C, various embodiments of the cover 200 are shown. The cover 200 may include a length, a width, a plurality of interlocking slats 210, an end slat 220, and a handle 230. The slats 210 may be longitudinal members extending a length that is substantially similar to the width of the cover, and may further include a first end 211 (i.e. a male end), a second end 212 (i.e. a female end), and a body 215. The slats 210 may be configured detachably couple an adjacent slat 210 such that a plurality of slats 210 may collectively form the cover 200. Furthermore, the interlocking slats 210 may couple together without the need for fasteners (i.e. nut and bolt, etc.), according to an exemplary embodiment. In such embodiments, the first end 211 may be received by the second end 212 of an adjacent slat 210. The first end 211 and second end 212 have a substantially semi-circular cross section, where the first end 211 and the second end 212 become substantially concentric about a common slat axis when coupled. When the slats 210 are coupled together, each of the slats 210 may pivot relative to adjacent slats 210 about the slat axis such that the cover 200 may be rolled, as shown in FIG. 1. In various embodiments, the slats 210 may pivot more than ninety degrees relative an adjacent slat 210. In another embodiment, the slats 210 may pivot less than ninety degrees relative to an adjacent slat 210. The structure of the slats 210 will be discussed in greater detail with reference to FIGS. 8A-8C.

The slats 210 may be formed from reinforced fiberglass, aluminum, sheet steel, or some other composite material adapted to withstand forces associated with ordinary use of the roll-off container 110. In some embodiments, the slats 210 may be sufficiently rigid to prevent undesired access to the cavity 160 of the roll-off container 110. In other words, it may be desirable for the slats 210 to withstand various impact forces, shearing forces, etc. Relatedly, the slats 210 may also be comprised of a material that is sufficiently durable as to not be permanently deformed during use. However, it may also be desirable for the slats 210 to be sufficiently flexible or pliable in order to accommodate contents of the roll-off container 110 that may protrude above the top 170. While proper use of the roll-off container 110 requires a user to refrain from filling the container 110 above a predefined volume limit (i.e. a maximum fill level proximate to but beneath the top 170), it may be the case that the contents of the roll-off container 110 may periodically exceed the predefined volume limit. In such cases, it may be desirable to have a cover that is sufficiently flexible or pliable to permit the cover 200 to enclose the cavity 160 as described above.

As noted above, the cover 200 further includes the end slat 220. The end slat 220 may positioned at a free end of the cover 200. Because the end slat 220 is positioned at the free end of the cover 200, the end slat 220 comprises a portion of the cover 200 that couples reaches the back wall 120 of the roll-off container 110. Contrariwise, a mating slat may be positioned at a fixed end of the cover 200 (i.e. the portion of the cover 200 that is coupled to the cover actuation assembly 300). As shown in FIGS. 8A-8E, the end slat 220 may be configured to couple to an adjacent slat 210. More particularly, the end slat 220 may have a second end 222 configured to receive the first end 211 of an adjacent slat 210. As is described in further detail below, a first end 221 of the end slat 220 may be coupled to the handle 230. Therefore, the end slat 220 may be coupled to one adjacent slat 210 at the second end 222 and to the handle 230 at the first end 221.

The handle 230 may be coupled to the end slat 220 and configured to facilitate the sliding of the cover 200 along the top 170 of the roll-off container 110 and within the cover track 180. In particular, the handle 230 may be a longitudinal member (i.e. angle iron having a substantially L-shaped cross section) that provides additional surface area upon which a user may grasp the free end of the cover 200 to pull the cover 200 over the cavity 160. In another embodiment, a plurality of handles 230 may be coupled to the end slat 220 for this same reason. Various embodiments may include commercially-available pull-handles or some other handle device coupled to the end slat 220 by welding, fasteners, or some other coupling means.

Figure 10:
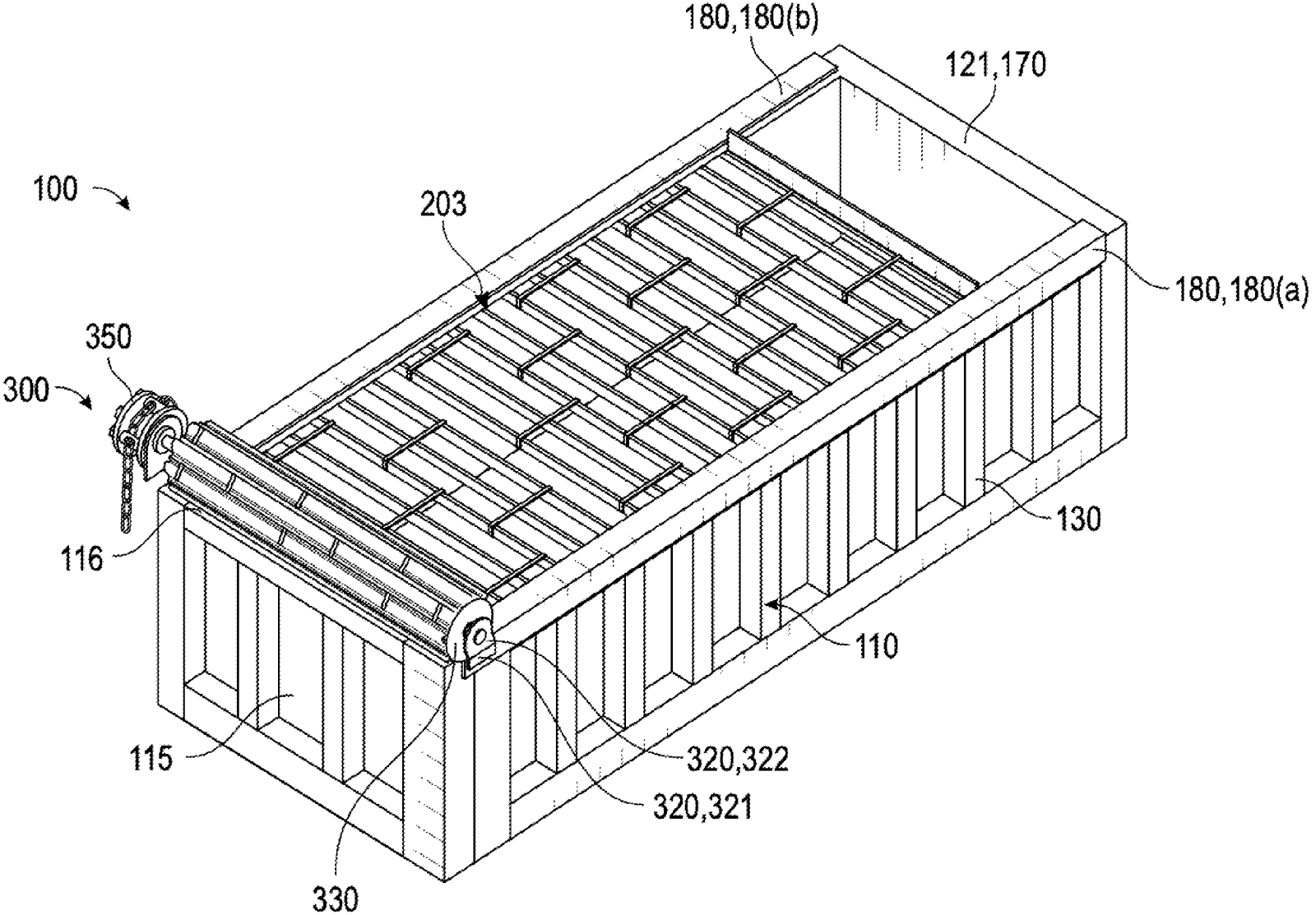
FIG. 10 is a perspective view of a roll-off container cover, according to an exemplary embodiment.
Figure 11:
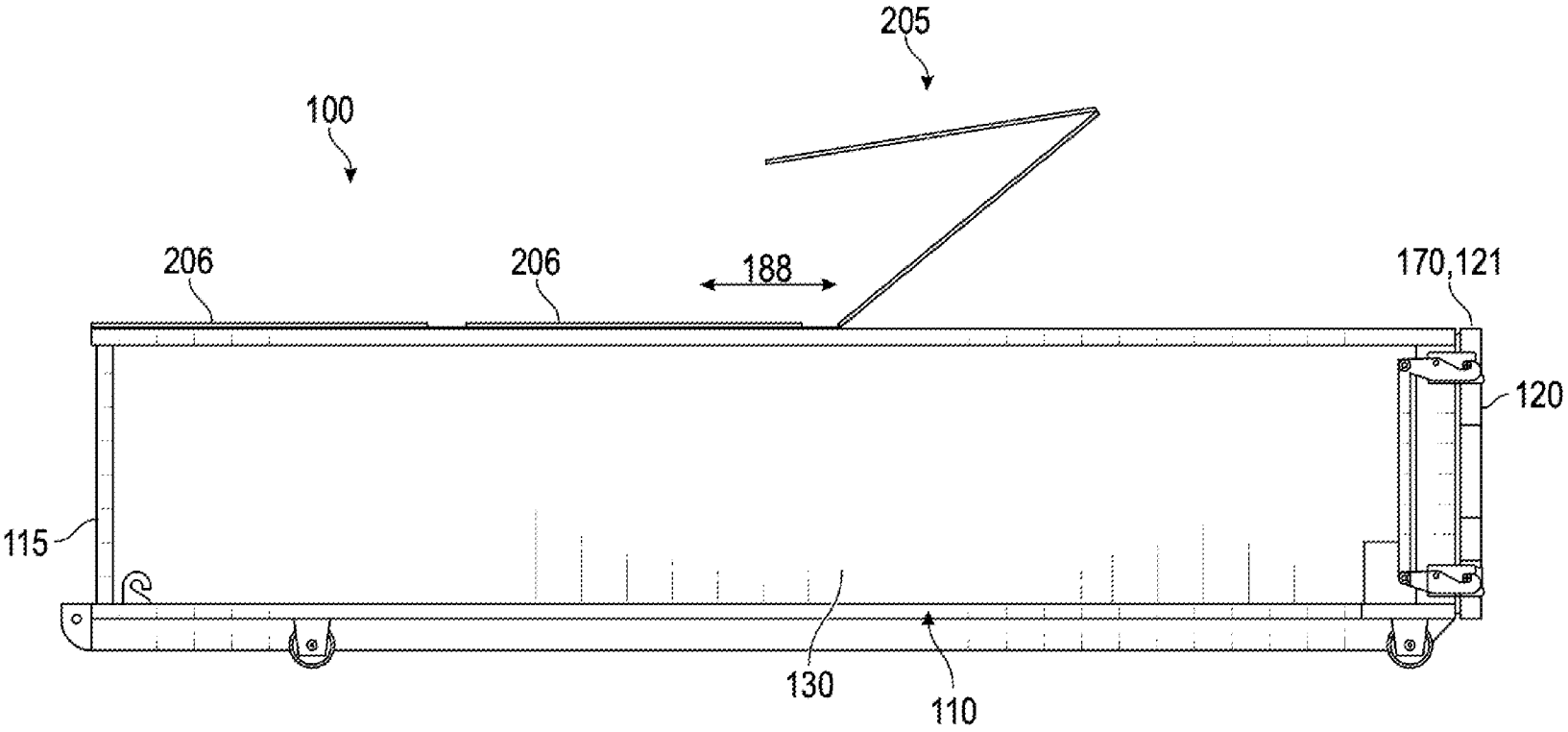
FIG. 11 is a right side view of an embodiment of a roll-off container cover, according to an exemplary embodiment.
Figure 12:
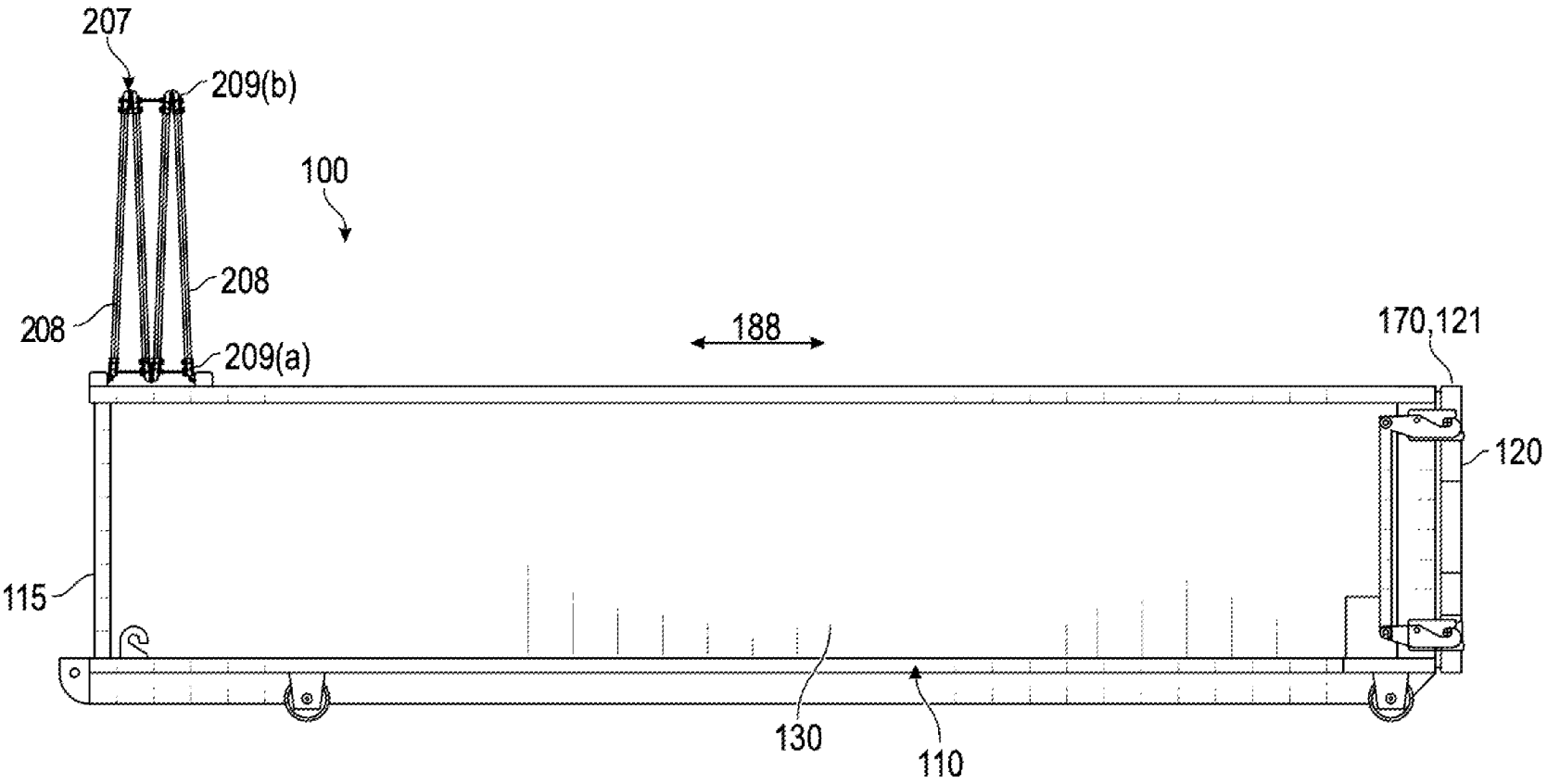
FIG. 12 is a right side view of an embodiment of a roll-off container cover, according to an exemplary embodiment.

While various embodiments of the roll-off container cover 100 include a cover 200 having a plurality of interlocking slats 210, other embodiments may include a cover 203 including a single structure, such as a tear-resistant fabric or netting, a metal net or chain-link structure, etc. having dimensions sufficiently large to enclose the cavity 160 (i.e. dimensions approximate to the length and width of the roll-off container 110), such as that shown in FIG. 10. Likewise, the cover 200 could be a foldable cover 205 that retracts in a by collapsing into a Z-fold or accordion style folded structure, such as the foldable cover 205 shown in FIG. 11. For example, the foldable cover 205 could include a plurality of large slats 206 capable of taking a Z-fold shape. In such embodiments, the cover track assembly 180 may be movable, pivotable, or detachable so as to expand cover envelope 185 to allow the foldable cover 205 to be folded without interfering with the cover track assembly 180. According to one embodiment, the slats 206 may be rotatable approximately 180 degrees relative to adjacent slat 210 in order to permit the Z-fold or according-style folding herein described. In another embodiment shown in FIG. 12, the cover 200 could be a collapsible cover 207 that includes a plurality of larger slats 208 (e.g., four slats 208 encapsulating the entire cavity 160) that could be foldable or interlockable to create a movable cover 200. For example, the large slats 208 could be foldable in an accordion style fold pattern, where a first end 209(*a*) of each slat 208 remains proximate to the top 170 of the container 110 in a collapsed position, while a second end of each slat 208 is separated from the top 170 in the collapsed position. In yet another embodiment, the cover 200 could be comprised of separate interlocking slats 210 that can be detached from each other and stowed on the roll-off container 110 when the cover 200 is retracted and interlocked across the top 170 of the container 110 when the cover 200 is deployed. In various embodiments where the cover 200 is foldable, each slat 210 may have a width that is approximately ¼th, ⅒th, ½0th or some other portion of the length of the container 110, according to one embodiment.

In various embodiments, the cover 200 may be configured to roll about an axis when in a retracted or partially-retracted state. Contrariwise, when in a deployed or partially-deployed state, the cover 200 may extend in a generally planar fashion across the top 170 of the roll-off container 110 within the cover tracks 180. To facilitate such deployment and retraction, the cover 200 may include a mounting slat coupled to the cover actuation assembly 300. The mounting slat may have a first end and a second end. The first end may be coupled (i.e. interlocked with) an adjacent slat 210 as described with respect to the slats 210 having first end 211 coupled to a second end 212 of an adjacent slat 210. The second end of the mounting slat may be detachably coupled to the cover actuation assembly 300 by fasteners (e.g., set screws, etc.) or some other coupling means. The mounting slat may include a similar structure to the above-described slats 210. In another embodiment, the mounting slat may be reinforced relative to the slats 210 in order to withstand any additional forces that may result by virtue of the mounting slat being coupled to the cover actuation assembly 300. Such reinforcement may be achieved by constructing the mounting slat from a different or additional material (e.g., by adding fiberglass reinforcement, etc.), for example.

Because the second end of the mounting slat is coupled to the cover actuation assembly 300, the cover 200 may be actuated by the cover actuation assembly 300. In particular and as discussed in detail below, the cover 200 may be rolled around an axle with rotation of said axle about an axis. Furthermore, because the slats 210 are interlockable and rotatable relative to adjacent slats 210, the cover may bend about the aforementioned axis upon which the axle rotates, as is depicted in FIG. 1. When rolled (i.e. retracted), the cover 200 may be confined to a relatively small space and positioned as to provide ample access to the cavity 160 of the roll-off container 110 as may be required during ordinary use. When unrolled (i.e. deployed), the cover 200 may take a generally planar form and extend over the cavity 160.

The cover 200 includes a minimum inner diameter when in the rolled (i.e. retracted) position. The minimum inner diameter is determined by the dimensions of the slats 210, such as the width of the slat 210 (i.e. the distance from the first end 211 to the second end 212) and the maximum degree of rotation permitted between adjacent slats 210 when interlocked. Furthermore, the minimum inner diameter may be sufficiently large to prevent the bending or distortion of or damage to individual slats 210 comprising the rolled cover 200 or rolled portion of the cover 200. In one embodiment, the minimum inner diameter of the rolled cover 200 may be approximately equal to five times the width of the slats 210, ten times the width of the slats 210, fifteen times the width of the slats 210, or any other value within or outside of (e.g., greater or lesser) this range.

As indicated above, the roll-off container cover 100 further includes cover actuation assembly 300, as shown in FIGS. 1-5. The cover actuation assembly 300 is configured to facilitate the deployment and retraction of the cover 200. More particularly, the cover actuation assembly 300 facilitates the rotation of the cover 200 in a first direction to roll the cover 200 (i.e. to retract the cover), and permits the rotation of the cover 200 in a second direction to unroll the cover 200 (i.e. to deploy the cover).

The cover actuation assembly 300 includes an axle 310 that rotates about an axis 315, one or more support brackets 320, and a drive mechanism 350. The support brackets 320 may include a container end 321 and an axle end 322 and may be coupled to the roll-off container 110. Specifically, the container end 321 of one support bracket 320 may be coupled to the first side wall 130 and the container end 321 of another support bracket 320 may be coupled to the second side wall 140. The support brackets 320 may be coupled to or coupled proximate to the top rail 131, 141 of the first and second side walls 130, 140, respectively. In this configuration, the axle end 322 of the support brackets 320 may extend above the top 170 of the roll-off container 110, as is shown in FIGS. 1, 2, and 4B.

The axle end 322 of the support bracket 320 may be configured to receive or rotatably coupled to the axle 310 such that the axle 310 may rotate freely about the axis 315 while the axle 310 is constrained in other directions (e.g., towards or away from the top 170) is prevented. In one embodiment, the axis 315 may extend perpendicular to the first side wall 130 and second side wall 140 and be fixed in such an orientation by virtue of the support brackets 320 as herein described. In another embodiment, the axle 310 may be fixedly coupled to the axle end 322 of the support bracket 320 such that the axle 310 is not permitted to rotate about the axis 315. Rather, a rotatable drive shaft 311 that defines a drive shaft aperture will rotate around the axle 310. Put another way, the fixed axle 310 will receive the rotatable drive shaft 311 and permit the drive shaft 311 to rotate around the axle 310 (and the thus about the axis 315), as described in further detail below. Accordingly, in various implementations, the rotatable axle or rotatable shaft or sleeve may comprise a rotatable element.

Figure 4A:
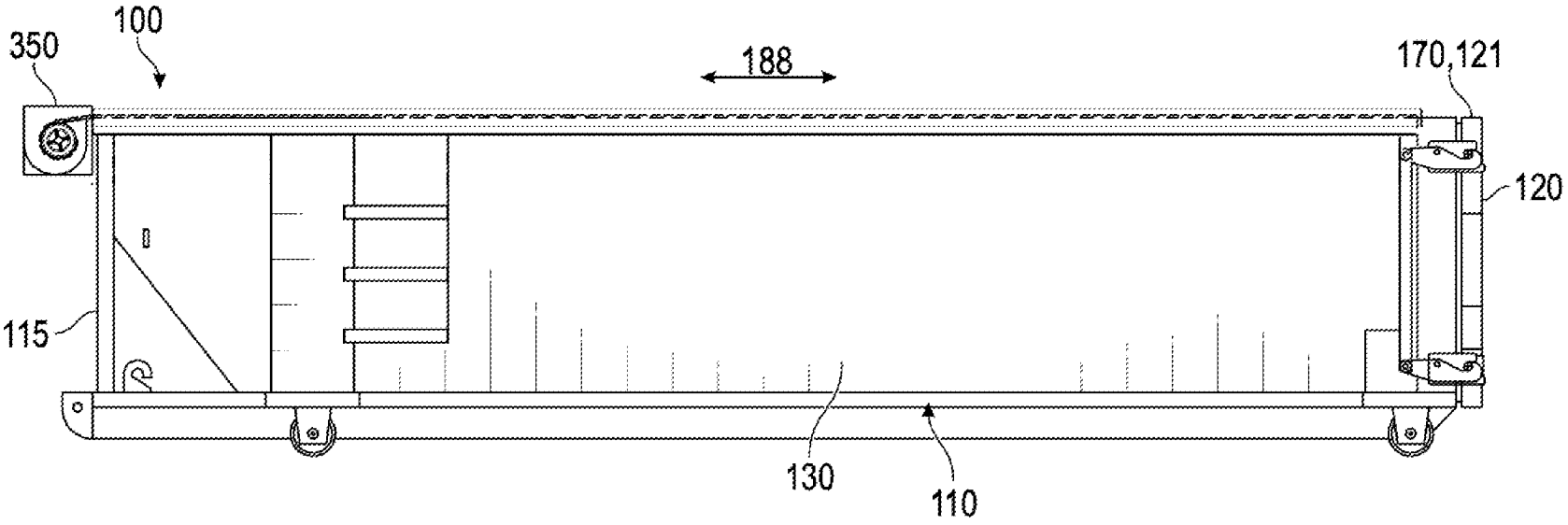
FIGS. 4A-4B are right side views of various embodiments of a roll-off container cover, according to an exemplary embodiment.
Figure 4B:
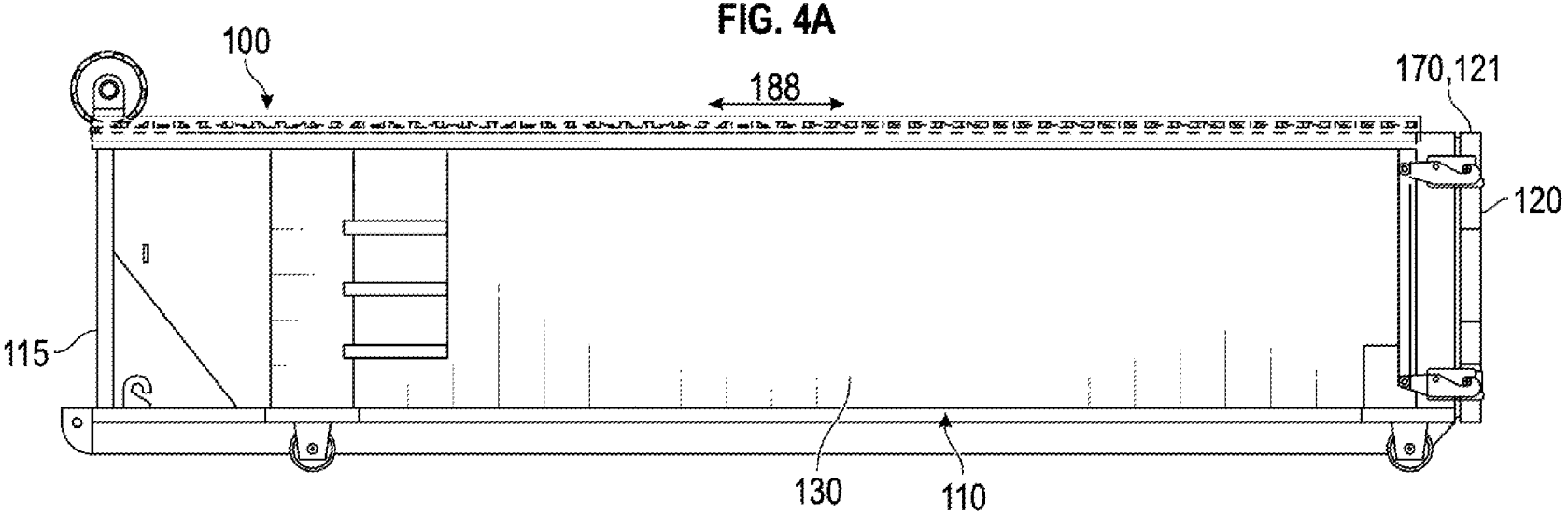

In another embodiment, the axle end 322 of the support bracket 320 may not be positioned below the top 170, but may instead extend from the front wall 115 in a direction substantially parallel to the top rails 131, 141 or cover track 180, as is shown in FIG. 4A. In this arrangement, the axle 310 (and the axis 315) are located beneath the top 170. In yet another embodiment, the support bracket 320 may be rotatably coupled to the first side wall 130 and second side wall 140 such that the axle 310 may be selectively positioned off of the front wall 115 (as shown in FIG. 4A) or off of the top 170 (as shown in FIG. 4B). Such adjustability may be desirable according to various space constraints experienced during use and transport of the roll-off container 110.

To facilitate the deployment and retraction of the cover 200, the axle 310 may be rotatably coupled to the support brackets 320. In one embodiment, ends of the axle 310 are coupled to the support brackets 320 by bearings. The bearings may be cylindrical roller bearings, spherical roller bearings, needle roller bearings, thrust bearings, or some other commercially-available bearing. According to one embodiment, the bearing may have an inner race element with an inner diameter defining an aperture. The axle 310 may be received within the aperture. The bearing may further include an outer race element having an outer diameter. The outer diameter may be received within an aperture of the support bracket 320, said aperture proximate to the axle end 322 of the support bracket 320. In such a configuration, the inner race element and the axle 310 coupled therewith may rotate relative to the outer race element the associated with the support bracket 320, for example. In yet other embodiments, the axle 310 may be received within an inner race element of the bearing, while an outer race element may be fixed relative to a bearing housing. The bearing housing may then be coupled to the axle end 322 of the support bracket 320 using fasteners or some other mating means.

In another embodiment, the axle 310 does not rotate relative to the support brackets 320. Rather, a rotatable drive shaft 311 having a cylindrical shape defining a drive shaft aperture with an inner diameter approximately equal to or greater than an outer diameter of the axle 310 may surround the axle 310 and rotate about the axle 310. In such embodiments, the secondary axle may be concentric to axle 310 and may thus rotate about the axis 315 by riding along a circumference of the axle 310 using bearings, a wet or dry lubricant, or some friction-reducing means. The rotatable drive shaft 311 may further include one or more grease fittings (e.g., Zerk fittings or similar fittings) to facilitate the application of grease or some other lubricant to the drive-shaft aperture and axle 310 in order to ensure the drive shaft 311 rotates about the axle 310 without undue friction. In yet another embodiment, the roll-off container cover 100 may have a plurality of secondary axles spaced at various intervals along the axle 310 and rotating around the axle 310 in the above-described manner.

The cover actuation assembly 300 may further include drums 330 spaced at various intervals along the axle 310. In one embodiment, the drums 330 have an inner diameter substantially similar to the outer diameter of the axle 310 and configured to receive the axle 310. In such embodiments, the drums 330 may be coupled to the axle 310 via set screws, via a keyway and key locking mechanism, etc. such that the drums 330 are securely positioned along the axle 310 and rotate with the axle 310. In another embodiment, the drums 330 may be coupled to the rotatable drive shaft 311 (via set screws or some other means) and may rotate about the axle 310 along with the rotatable drive shaft 311. The drums 330 may further have an outer diameter approximately equal to or greater than the minimum inner diameter of the cover 200 when in a rolled (i.e. retracted) or partially rolled (i.e. partially retracted) position. As noted above, the minimum inner diameter of the rolled cover may be determined by the width of the slats 210 that comprise the cover 200 and a desire to avoid damaging, distorting, or deforming the slats 210 when the cover 200 is rolled. Accordingly, the outer diameter of the drums 330 may be sufficiently large as to prevent damage to the slats 210 when the cover 200 is rolled.

As indicated above, the drums 330 may be spaced at various intervals along the axle 310. In some embodiments, a plurality of drums 330 are coupled to the axle 310 and spaced from adjacent drums 330 at intervals sufficient to prevent the bending or flexing of the slats 210 under gravitational or other loads while simultaneously reducing weight or the need for superfluous components. In another embodiment, a single drum spanning all or a substantial portion of the cover width along the axle 310.

In some embodiments, the mounting slat of the cover 200 may be coupled directly to the drums 330 via set screws or some other fastening means such that the rotation of the axle 310 about the axis 315 causes the mounting slat to rotate with the axle 310. Rotation of the mounting slat with the axle 310 further causes the cover 200 to rotate about the axle 310 such that the cover 200 rolls about the axle 310, namely during retraction of the cover 200.

In another embodiment, the drums 330 may be coupled to one or more of the secondary axles described above. Moreover, the drums 330 may act as one or more secondary axles and may thus rotate about the axle 310 in embodiments featuring a fixed axle 310. In this configuration, the drums 330 serve to space the mounting slat of the cover 200 to the axle while simultaneously facilitating rotation of the cover about the axle 310 during deployment and retraction of the cover 200, which may serve to minimize the number of components necessary for the cover actuation assembly 300.

In yet another embodiment, the cover actuation assembly 300 may not include one or more secondary axles or drums. In such embodiments, the mounting slat of the cover 200 may be coupled directly to the axle 310 via set screws or some other fastening means such that the rotation of the axle 310 about the axis 315 causes the mounting slat to rotate with the axle 310. Rotation of the mounting slat with the axle 310 further causes the cover 200 to rotate about the axle 310 such that the cover 200 rolls about the axle 310, namely during retraction of the cover 200.

Figure 3:
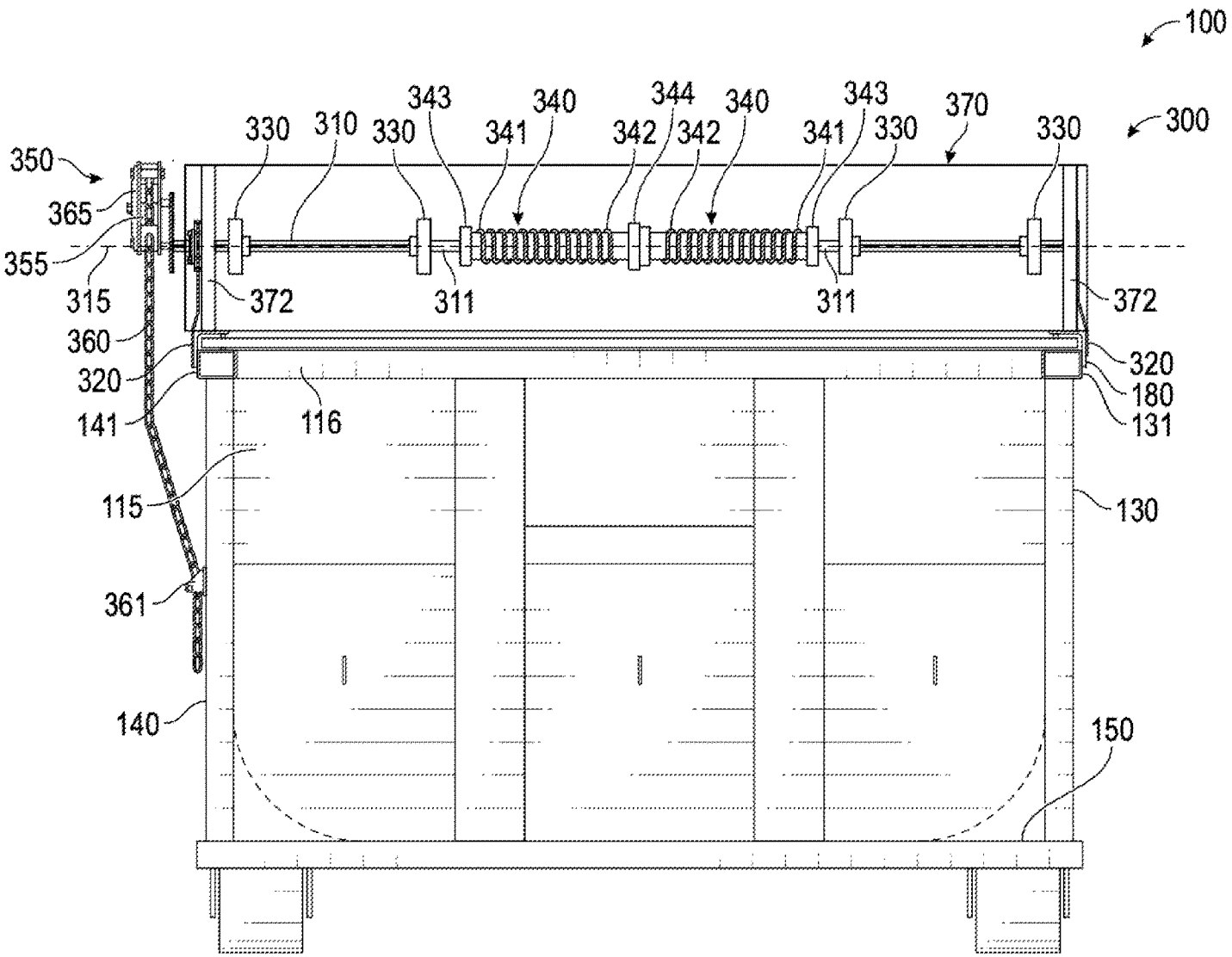
FIG. 3 is a front view of the roll-off container cover of FIG. 1, according to an exemplary embodiment.

The cover actuation assembly 300 further includes a drive mechanism 350, as shown in FIGS. 1-5. The drive mechanism 350 is adapted to cause rotation of the axle 310, which in turn causes the rolling of the cover 200 about the axle 310. The drive mechanism 350 can be a manual drive mechanism (i.e. one harnessing human power), a powered drive mechanism (e.g., a mechanism harnessing electrical power), or an automated drive mechanism (i.e. a mechanism harnessing electrical power in conjunction with one or more sensors or limit switches to control actuation). According to one embodiment as shown in FIGS. 1 and 3, the drive mechanism 350 may be coupled to an end of the axle 310. In other embodiments, the roll-off container cover 100 may include two drive mechanisms 350, one coupled to each of the two ends of the axle 310.

Figure 5:
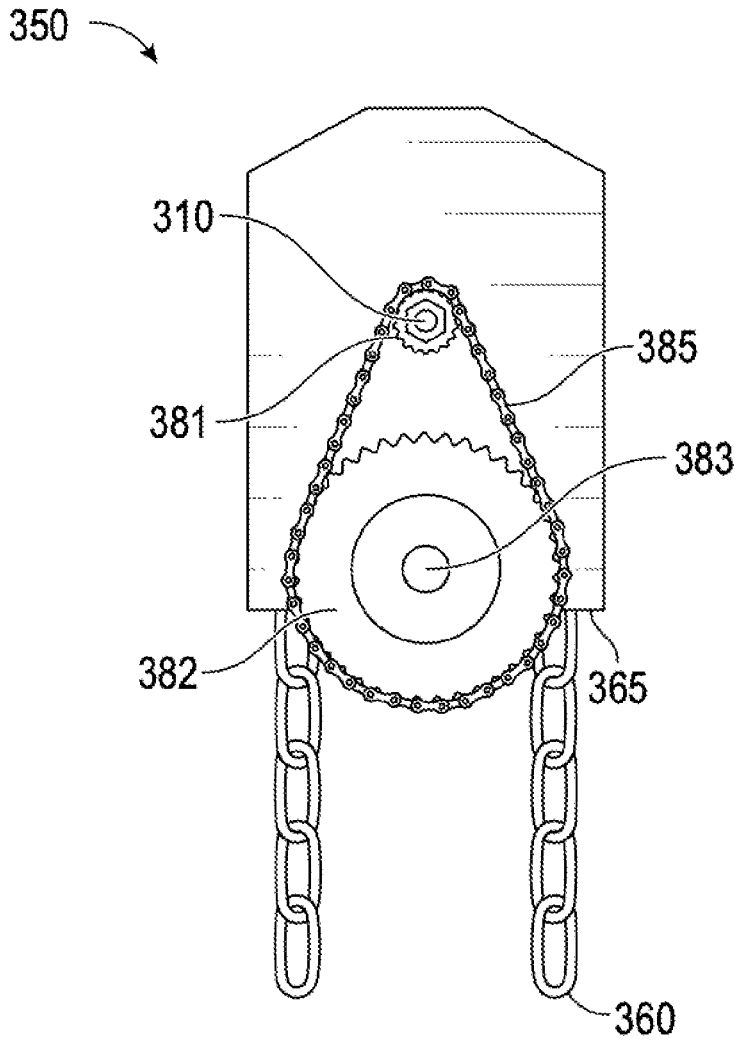
FIG. 5 is a front view of a drive mechanism of a roll-off container cover, according to an exemplary embodiment.

As shown in FIGS. 1, 3, and 5, the drive mechanism 350 may be a chain pocket pulley device, according to one embodiment. In such embodiments, the drive mechanism 350 may include a pulley device 355 coupled to the axle 310, a chain 360, and an optional housing 365. The chain 360 may be coupled to the pulley device 355. The pulley device 355 may define an aperture, namely a bore extending through a center of the pulley device 355. The pulley device 355 may further include a groove with a groove surface. The aperture is adapted to receive the axle 310 such that the axle 310 and the pulley device 355 are concentric about the axis 315. The pulley device 355 is further configured to couple to the axle 310 such that rotation of the pulley device 355 causes rotation of the axle 310 and vice versa. For example, the pulley device 355 may be coupled to the axle 310 by set screw or other fastening means. In another embodiment, the aperture of the pulley device 355 may include a key that is received within a keyway of the axle 310. In yet another embodiment, the pulley device 355 may be welded to the axle 310.

According to one embodiment, the chain 360 may be received by the groove. The groove surface may be a rough or uneven surface such that interference (i.e. engagement or friction) is created between the chain 360 and the groove surface when the chain 360 is pulled in a direction tangential to the pulley device 355. The interference between the chain 360 and the groove surface thus causes the pulley device 355 to rotate. Accordingly, when the chain 360 is pulled (e.g., in a downward direction), the pulley device 355 rotates, thereby causing the axle 310 to rotate about the axis 315. The chain 360 may be a looped chain (i.e. a continuous chain with no free end) and may further have a slumped end that hangs beneath the pulley device 355 and housing 365 under typical gravitational forces. In one embodiment, a chain-catch device 361 may be coupled to roll-off container 110 beneath the drive mechanism 350 to catch the slumped end of the chain 360.

Referring now to FIG. 5, the drive mechanism 350 may also include one or more pulley or sprocket devices working in conjunction in a differential pulley assembly. For example, a small sprocket 381 may be coupled to the axle 310 such that the small sprocket 381 and the axle 310 are concentric about the axis 315 and cooperatively rotate about the axis 315. A large sprocket 382 may be coupled to a second shaft 383 extending perpendicularly from the first or second side wall 130, 140 of the roll-off container 110 and positioned proximate to the small sprocket 381. For example, the large sprocket could be positioned directly beneath (i.e. closer to the bottom 150 of the roll-off container 110, but approximately equidistant from the front wall 115 and side walls 130, 140 of the roll-off container 110) or directly above (i.e. closer to the top 170 of the container 110, but approximately equidistant from the front wall 115 and side walls 130, 140 of the container 110) the small sprocket 381. The second shaft 383 may also be coupled to the housing 365, according to another embodiment. The large sprocket 382 may be permitted to freely rotate about the second shaft 383. A sprocket chain 385, such as a bicycle-type chain or similar device may couple the small sprocket 381 and the large sprocket 382 such that rotation of one of the small sprocket 381 and the large sprocket 382 causes rotation of the other. A pulley device, similar to the pulley device 355 of FIG. 3, may be located within a housing 365 and may be coupled to and rotate about the second shaft 383. The pulley device may therefore be rotationally coupled to the large sprocket 382 such that rotation of the pulley device causes rotation of the large sprocket 382, and thus in turn causes the rotation of the small sprocket 381. Like the pulley device 355 of FIG. 3, the pulley device may be coupled to a hand chain 360, where tension applied to the hand chain 360 causes the pulley device to rotate, which in turn causes the sprockets 381 and 382 to rotate. In this embodiment, the cooperation of multiple sprockets 381, 382 with a single chain 385 serves to create mechanical advantage that reduces the force required to rotate the axle 310, which may be necessary in certain circumstances where the cover 200 to which the axle 310 is coupled is heavy, for example.

Rather than being driven by a chain 360, the drive mechanism 350 may include a foldable lever or handle that may be used to rotate the axle 310. For example, a collapsing crank lever may be used to rotate the axle 310, where the lever is adapted to rotate about the axis 315 and has a lever arm with a sufficiently large length to enable ordinary persons to rotate the axle 310. When used to rotate the axle 310 (i.e. to retract the cover 200), the collapsing crank lever may be in an operating position (e.g., unfolded, expanded, etc.). When not used to rotate the axle 310, the collapsing crank lever may be collapsed (e.g., folded), for example. In another embodiment, the axle 310 (or rotatable drive shaft 311) may be rotated using wrench, impact driver, or some other device. More particularly, a rotatable nut or similar device may be coupled to an end of the axle 310 or rotatable drive shaft 311 and may be configured to rotate and in turn cause the axle 310 or rotatable drive shaft 311 to rotate. For example, an impact driver may be used to apply rotational energy to the nut to rotate the axle 310 or rotatable drive shaft 311, which further causes the cover 200 to retract or deploy, according to an exemplary embodiment.

In yet another embodiment, the drive mechanism 350 may be a powered drive mechanism. For example, the drive mechanism may be powered by a direct drive electric motor including a brushless DC motor, according to one embodiment. The direct drive motor may include a bore adapted to receive or couple to the axle 310. When the direct drive motor is powered, the axle 310 rotates about the axis 315, thereby causing the cover 200 to retract or deploy, according to one embodiment. In other embodiments, another electric motor (direct drive or otherwise) may be used to rotate the axle 310 with or without a pulley device, a belt, a gearbox, or similar corresponding components. For example, a 115 VAC, 60 Hz, 0.5 HP AC motor coupled to a pulley device that drives a belt when the motor is powered, the belt further driving the axle 310. In various embodiments having a powered drive mechanism 350, the electric motor may be powered by a battery coupled to the roll-off container cover 100 or by an external power source (i.e. by cord to a nearby electrical outlet).

In embodiments featuring a powered drive mechanism 350, the cover actuation assembly 300 may further include limit switches, sensors, radio receivers, etc. to automate the actuation of the cover 200. For example, the cover actuation assembly 300 may include a radio receiver configured to receive a signal from a radio transmitter and, in response to receiving the signal, cause power to be delivered to the drive mechanism 350, thereby causing the retraction or deployment of the cover 200. Relatedly, the cover actuation assembly 300 may include one or more limit switches or rotary encoders configured to determine the position of the cover 200 and further determine the state of the cover 200 (e.g., in a deployed state, a partially deployed state, or a retracted state). In other words, various sensors or switches may be included in order to monitor the cover 200 position directly, such as by a limit switch positioned proximate the back wall 120 of the roll-off container 110, or indirectly by monitoring the rotation of the axle 310. In another embodiment, motion sensors, proximity sensors, or other devices may be positioned proximate to or within the cavity 160 to detect the presence of an obstruction and halt the deployment or retraction of the cover 200 to minimize the risk of injury. Such automated systems may further comprise a computer having a memory and a processor, the processor configured to execute instructions stored on the memory. Said computer may be communicably coupled to the one or more switches, sensors, encoders, receivers, or transmitters, according to one embodiment.

The cover actuation assembly 300 may also include one or more torsion springs 340 coupled to the axle 310 and to the roll-off container 110. For example, a torsion spring 340 may be coupled at a free end 341 to the axle 310 and at a stationary end 342 to a portion of the cover actuation assembly 300 that remains fixed relative to the axle 310. In such an arrangement, the rotation of the axle 310 causes the torsion spring 340 to create a spring force that assists in the retraction or deployment of the cover 200, according to one embodiment. Specifically, the free end 341 of the torsion spring 340 may be coupled to the axle 310 via a winding element 343, such as a winding cone as may be common in overhead garage door applications, where said winding element 343 rotates with the axle 310 and interacts with the free end 341 of the torsion spring 340 to cause rotation of the torsion spring 340 at the free end 341. The stationary end 342 of the torsion spring 340 may be coupled to a stationary element 344, such as a stationary cone as is common in ordinary overhead garage door applications, where said stationary element 344 does not rotate with the axle 310 and that interacts with the stationary end 342 of the torsion spring 340. As the axle 310 rotates in a first direction (e.g., the direction of rotation associated with deployment of the cover 200), the free end 341 of the torsion spring 340 winds via the winding element 343, while the stationary end 342 remains stationary via the stationary element 344. The winding of the free end 341 relative to the stationary end 342 during rotation of the axle 310 in a first direction causes the torsion spring 340 to generate torque forces that are stored in the torsion spring 340. When the axle 310 subsequently rotates in a second direction, the stored spring forces assist the retraction or deployment of the cover 200 by contributing said stored spring force toward the translation of the cover 200 within the cover track 180.

While the embodiments herein described include a cover actuation assembly 300 that includes a rotatable axle 310 or a secondary axle that rotates about the axle 310 to facilitate the rotation of the cover 200 about the axle 310, it is contemplated that other actuation means not involving rotation of the cover 200 about the axle 310 are possible. For example, other embodiments may include a cover 200 having slats 210 that fold about the common slat axes that exist between interlocking slats 310, as described above. In a retracted position, the slats 210 may each be oriented substantially perpendicular to an orientation of the slats while in a deployed position such that the cover 200 features a Z-fold or accordion-style fold pattern when retracted. Accordingly, the cover 200 may be retracted without rolling the cover 200 about an axle 310 in various embodiments.

Figure 6A:
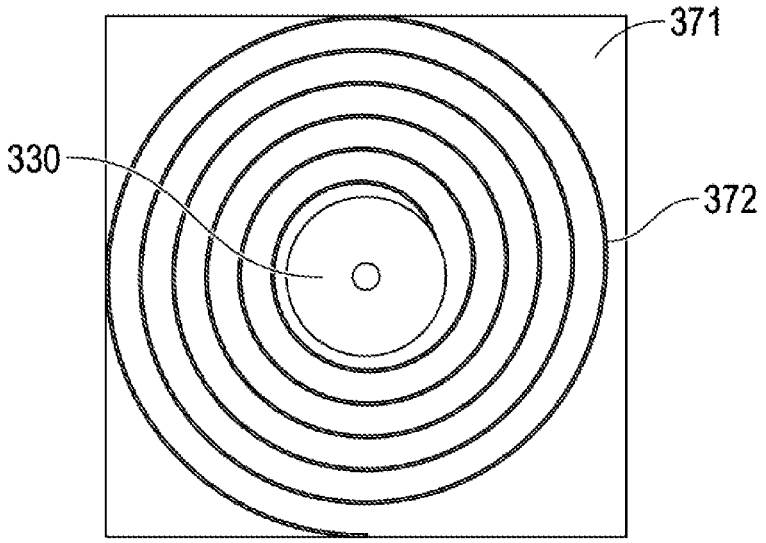
FIGS. 6A-6B show various embodiments of a spiral guide of the roll-off container cover of FIG. 2, according to an exemplary embodiment.
Figure 6B:
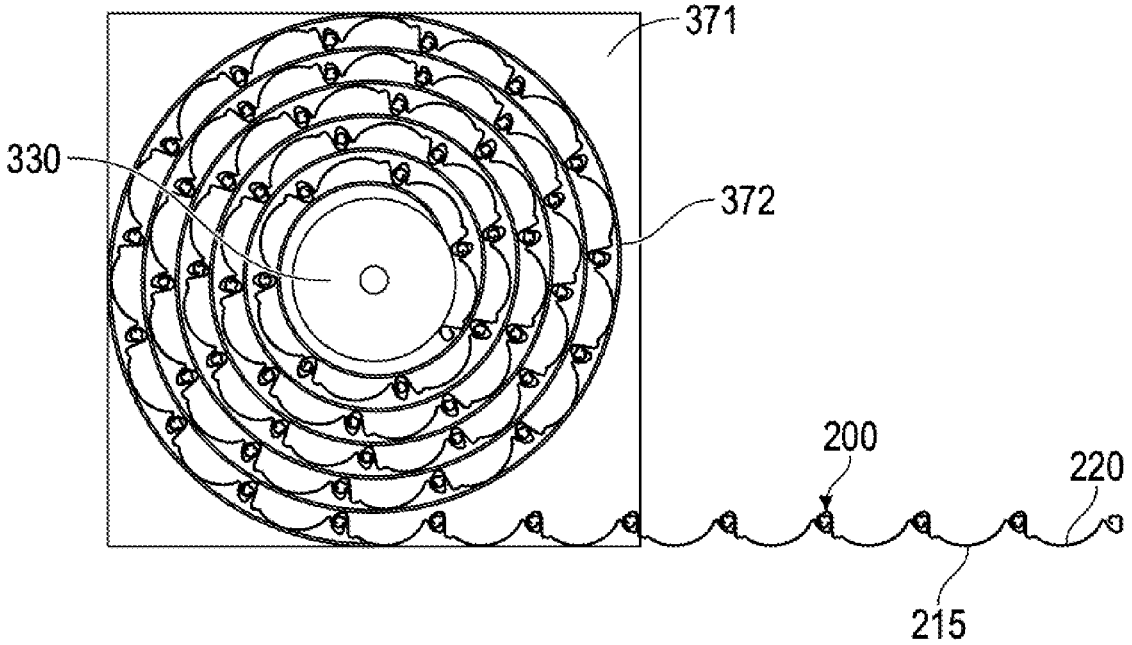

Referring now to FIGS. 2, 6A, and 6B, the roll-off container cover 100 is shown with a cover actuation assembly 300 that includes a cover actuation assembly enclosure 370. The cover actuation assembly enclosure 370 may include one or more end plates 371 and a spiral guide 372 and is configured to protect the cover actuation assembly 300 and the rolled cover 200 from damage, debris, etc., according to one embodiment. The cover actuation assembly enclosure 370 may also be configured to prevent unauthorized or dangerous access to the various moving components of the cover actuation assembly 300 that may otherwise occur if a cover actuation enclosure 370 were not present. In one embodiment, the cover actuation assembly enclosure 370 may be constructed from mild steel plates which are welded together to form the generally parallelepiped shape of the cover actuation assembly enclosure 370. In some embodiments, the cover actuation assembly enclosure 370 encapsulates the entire cover actuation assembly 300, including the drive mechanism 350. According to other embodiments, the cover actuation assembly enclosure 370 does not encapsulate the drive mechanism 350 or other components of the cover actuation assembly 300. In yet other embodiments, the cover actuation assembly enclosure 370 may be fixedly coupled to the roll-off container 110 or cover actuation assembly 300 (e.g., to the support brackets 320). However, in other embodiments, the cover actuation assembly enclosure 370 may be removable from the roll-off container 110 or cover actuation assembly 300, whether in whole or in part. For example, an end plate 371 may be removable as to permit temporary and periodic access to the cover 200 or cover actuation assembly 300 for maintenance or other such purpose.

The spiral guide 372 of the cover actuation assembly 300 may be a protrusion extending perpendicularly from the end plate 371 in a generally-spiraled arrangement, as shown in FIGS. 6A and 6B. According to one embodiment, the spiral guide 372 may extend a relatively short distance from the end plate 371, such as one to six inches (2.5-15.25 cm). In one embodiment, the spiral guide 372 may extend from the end plate 371 and form a generally Archimedean spiral shape. The spiral guide 372 may be welded or otherwise rigidly secured to the end plate 371. The spiral guide 372 may be configured to receive the cover 200 and assist the rolling of the cover 200 into a rolled orientation. Put another way, the spiral guide 372 may serve to prevent the cover 200 from folding, creasing, bending, or deforming as the cover 200 is rolled around the axle 310 or drums 330. Furthermore, the spiral guide 372 also prevents the cover 200 from binding, jamming, or coiling-out within the cover actuation assembly 300 when the cover 200 is being retraced or deployed and when rotational force is being exerted about the axis 315, according to one embodiment. In another embodiment, the spiral guide 372 may be integrally formed with the cover actuation assembly enclosure 370. In yet another embodiment, more than one spiral guide 372 may be implemented, for example.

Figure 7C:
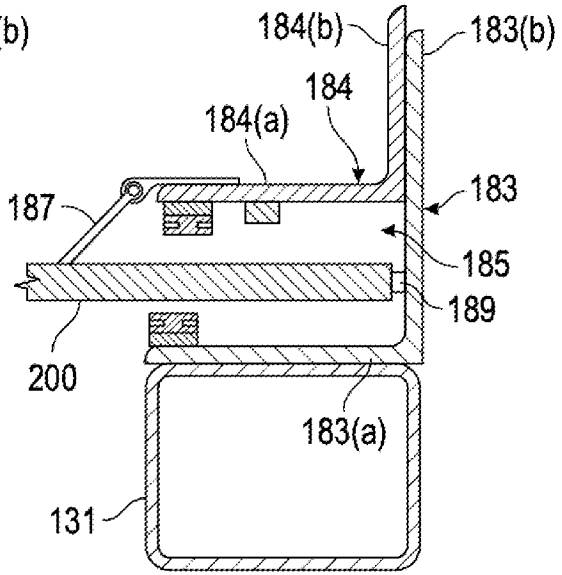
FIGS. 7A-7C show various embodiments of a cover track assembly of the roll-off container cover of FIG. 1, according to an exemplary embodiment.
Figure 7B:
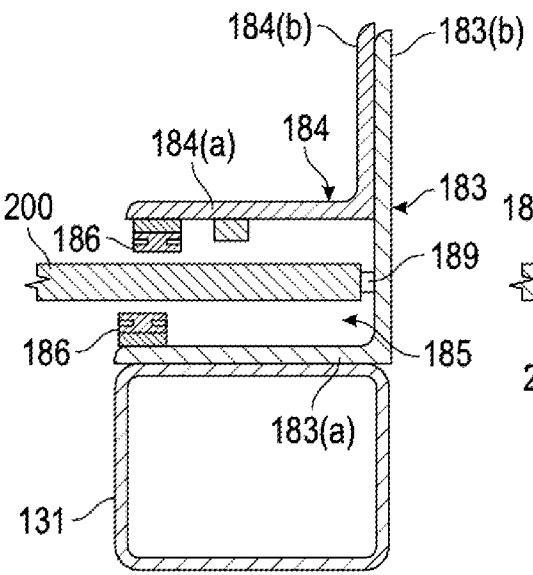
Figure 7A:
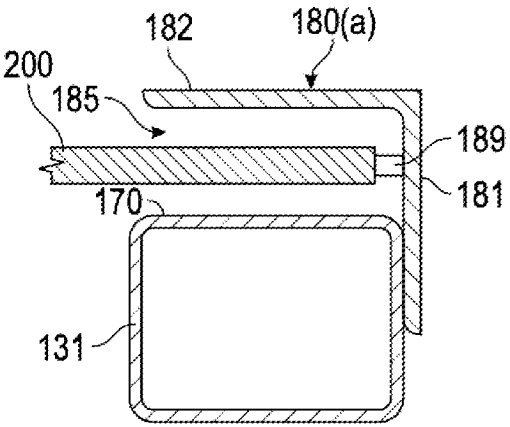

Referring now to FIGS. 7A-7C, various embodiments of the cover track assembly 180 are shown. As discussed above with reference to FIG. 1, the cover track assembly 180 may be coupled to the top rail 131, 141 of the first side wall 130 and second side wall 140 respectively. FIGS. 7A-7C show cross-sectional views of the cover track 180(*a*), which is coupled to the top rail 131 of the first side wall 130. It should be understood, however, that the cover track 180(*b*), which is coupled to the top rail 141 of the second side wall 140, may be a mirror image of the cover track 180(*a*) cross sectional views shown in FIGS. 7A-7C. In other words, both the cover tracks 180(*a*), 180(*b*) may exhibit similar or substantially identical cross-sectional characteristics.

As depicted in FIG. 7A and as discussed above, the cover track 180(*a*) includes a first portion 181 coupled to the top rail 131 and a second portion 182 spaced a distance 182(*a*) from the top 170. The cover envelope 185 is defined by the second portion 182 and the top 170. The cover 200 is received within the cover envelope 185 and extends at least partially over the top rail 131 and underneath the second portion 182. In this way, the cover 200 is trapped within the cover envelope 185 such that any undesired movement of the cover 200 in a vertical direction (either into the cavity 160 of the roll-off container 110 or above the roll-off container 110 may be prevented. In one embodiment, the cover track 180(*a*) as shown in FIG. 7A may be a commercially available angle iron or extruded aluminum product. In other embodiments, the cover track 180(*a*) of FIG. 7A may comprise some other commercially-available material or specially-fabricated product.

Turning now to FIG. 7B, a second embodiment of the cover track assembly 180 is shown. In this embodiment, the cover track assembly 180 includes a cover track 180(*a*), which further includes a lower track member 183 and an upper track member 184. The lower track member 183 may be coupled to the top rail 131 of the first side wall 130 and may have a first portion 183(*a*) and a second portion 183(*b*), where the first portion 183(*a*) may be substantially parallel to the top 170 of the roll-off container 110, while the second portion 183(*b*) may be substantially perpendicular to the top 170. The upper track member 184 may be coupled to the lower track member 183 and may include a first portion 184(*a*) and a second portion 184(*b*). The first portion 184(*a*) of the upper track member 184 may be substantially parallel to the top 170 and to the first portion 183(*a*). The second portion 184(*b*) may be substantially perpendicular to the top 170. In one embodiment, the upper track member 184 is nested within the lower track member 183 and spaced a distance 184(*c*) from the first portion 183(*a*) of the lower track member 183. As can be seen in FIG. 7B, the second portion 184(*b*) of the upper track member 184 is coupled to the second portion 183(*b*) of the lower track member 183 in order to create the aforementioned nested arrangement. Thus, the first portion 183(*a*) of the lower track member 183 and the first portion 184(*a*) of the upper track member 184 together create the cover envelope 185.

Similar to the embodiment described with reference to FIG. 7A, the embodiment of the cover track assembly 180 shown in FIG. 7B is configured to receive the cover 200 within the cover envelope 185. As discussed previously, when within the cover envelope 185, undesired movement of the cover 200 may be prevented. Instead, the cover 200 may translate within the cover envelope 185 to deploy and retract the cover. Because the embodiment of FIG. 7B includes a lower track member 183, the cover 200 is received by a cover envelope 185 that is bounded by both the lower track member 183 and the upper track member 184. In other words, the cover 200 is not bounded by top rail 131 itself, but is instead bounded by components coupled to the top rail 131.

In some embodiments, the cover track assembly 180 may include a cover guide 189 configured to guide the cover 200 within the cover tracks 180(*a*), 180(*b*) and facilitate the straight and uniform deployment of the cover 200 in direction 188 along the top 170 of the container 110. For example, the cover guide 189 could be a spring-loaded clip or roller coupled to the first portion 181 of the cover tracks 180(*a*) and 180(*b*) and contacts opposing ends of the cover 200 to create a biasing or centering force that maintains an appropriate distance between the end of the cover 200 and the first portion 181. In this way, the cover guide 189 will prevent an end of the cover 200 from contacting the first portion 181 of the cover track 180(*a*) and 180(*b*) during deployment or retraction of the cover 200, as may occur if the cover 200 is deployed/retraced in a direction that diverges slightly towards either the first side 130 or second side 140 relative to the direction 188. In other embodiments, the cover guide 189 could be a leaf spring-type device, a wheel on a spring-loaded arm, sacrificial lubricating material (e.g., PTE or nylon), etc. In yet other embodiments, the cover guide 189 could be coupled to ends of the cover 200 (i.e. to the ends of the slats 210) and may interact with the first portion 181 as the cover 200 moves within the cover envelope 185.

As shown in FIG. 7B, the cover track assembly 180 may also include one or more friction-reducing elements 186. The friction-reducing elements 186 may be coupled to the first portion 183(*a*) of the lower track member 183 and to the first portion 184(*a*) of the upper track member 184, as depicted. In one embodiment, two friction-reducing elements 186 may be disposed between said lower and upper track members 183, 184 and the cover 200 such that the cover 200 may translate between the friction-reducing elements 186, rather than translating within and interacting directly with the lower and upper track members 183, 184. The friction-reducing elements 186 may be high-density plastic strips having a low friction coefficient, a plurality of bearings (e.g., roller ball bearings, cylindrical bearings, etc.), a plurality of rotatable wheels, or some other device. In various embodiments, the friction-reducing elements 186 may be detachably coupled within the cover envelope 185 in order to allow for maintenance, cleaning, and replacement, as may be necessary after prolonged use of the roll-off container cover 100.

In another embodiment, the cover 200 may include one or more friction reducing elements that interact with the cover track assembly 180 to reduce friction and aid in the translation of the cover 200 within the cover tracks 180(*a*), 180(*b*). For example, a plurality of wheels may be rotatably attached to an end of the one or more slats 210 and may ride within the cover envelope 185 to facilitate retraction and deployment of the cover 200. In another embodiment, another friction reducing element may be used in a similar manner, such as roller ball bearings, high-density plastic strips, etc.

Furthermore, as shown in FIG. 7C, the cover track assembly 180 may further include a weather guard device 187 coupled to the cover track 180(*a*). The weather guard device 187 may be adapted to shield various components of the cover track assembly 180 from weather elements (e.g., rain, snow, ice, etc.) and to prevent debris from entering the cover envelope 185. More particularly, the weather guard device 187 may provide a barrier separating the components within the cover envelope 185 (i.e. the friction reducing elements, the cover track 180(*a*)) from an outside environment. The weather guard device 187 thus prevents debris or weather elements from entering the cover envelope 185 and inhibiting the translation of the cover 200 within said envelope, for example. The weather guard device 187 may be a rubber strip or gasket, according to one embodiment. In another embodiment, the weather guard device 187 may be a nylon bristle brush or similar brush-type device. The weather guard device 187 may be serviceable such that all or a portion of the weather guard device 187 may be removed or replaced. According to one embodiment, the weather guard may be coupled to the second portion 182 of the cover track assembly 180 of FIG. 7A. In another embodiment, the weather guard may be coupled to the first portion 184(*a*) of the upper track member 184 as shown in FIG. 7C.

Referring now to FIGS. 8A-8E, various embodiments of slats 210 are shown. Each of the slat 210 designs shown in FIGS. 8A-8E include a first end 211, a second end 212, an overall slat thickness 214, a slat body 215, and a slat wall thickness 216, according to an exemplary embodiment. As noted above, the first end 211 of a slat 210 may be interlockable with the second end 212 of an adjacent slat 210. Also as noted above, the cover 200 may include an end slat 220 and a handle 230 coupled to the end slat 220, as is shown in further detail in FIGS. 8A-8E. In one embodiment, the slats 210 may be manufactured from extruded aluminum (e.g., sheet, extruded, or otherwise), extruded fiberglass, sheet steel, a composite material (e.g., nylon or carbon fiber), or some other suitable material. The overall slat thickness 214 is less than the distance 182(*a*) between the top 170 of the roll-off container 110 and the second portion 182 of the cover tracks 180(*a*), 180(*b*), including in embodiments including friction-reducing elements 186, so as to allow the cover 200 to be received within the cover envelope 185. The slat wall thickness 216 may vary according to user specifications. In one embodiment, the slat wall thickness 216 will be small relative to the overall slat thickness 214, which serves to reduce the cost associated with manufacturing the slats 210 and reduce a weight of the cover 200 to reduce the effort required to retract and deploy the cover 200.

Figures 8A, 8B, 8C, 8D, 8E:
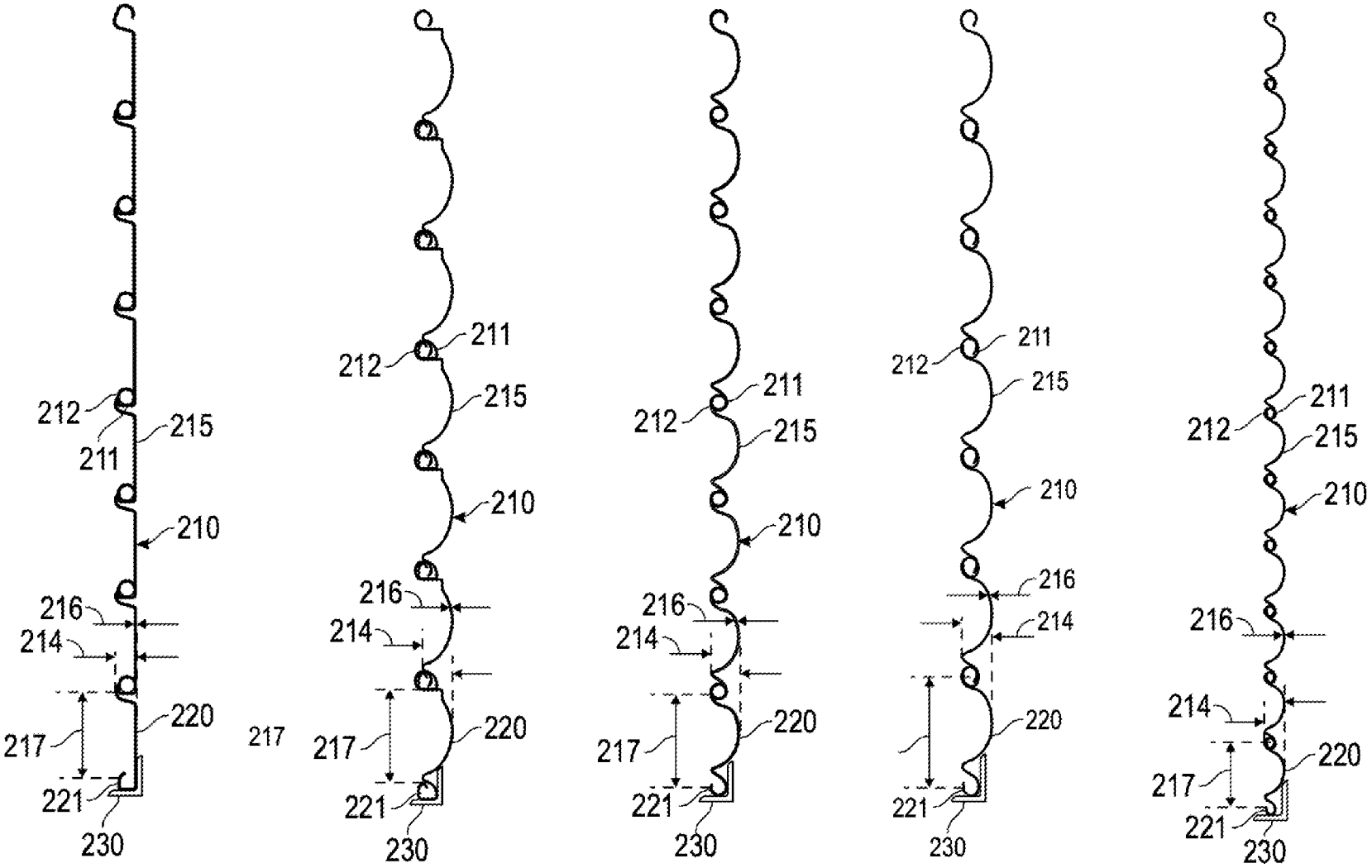
FIGS. 8A-8E show various embodiments of a cover of the roll-off container cover of FIG. 1, according to an exemplary embodiment.

The various slat 210 embodiments depicted in FIGS. 8A-8E represent only some of the slat 210 designs that may comprise the cover 200 of the roll-off container cover 100, according to the present disclosure. The slat body 215 of each slat 210 variation may include a substantially flat portion, such as slat body 215(*a*) as shown in FIG. 8A, while other slats 210 may have a slat body 215 featuring a generally semi-circular, bowed, or curvilinear shape, as shown in FIGS. 8B-8E. The slats 210 may also vary in size, as is depicted in FIGS. 8B-8D, which depict slats 210 having similar cross-sectional shape but varying cross-sectional dimensions.

In addition to having one of a variety of cross sectional shapes, the slats 210 may also define a plurality of drain apertures. More particularly, the slats 210 may have a plurality of drain apertures configured to permit water or other fluids to flow or drain from a top of the cover 200 (i.e. from outside the roll-off container 110) to underneath the cover 200 (i.e. into the cavity 160 of the roll-off container 110), which may be necessary to prevent rain water or other liquids from pooling atop the cover 200 and potentially causing damage thereto. Each slat 210 may include a plurality of drain apertures located proximate to one or more of the first end 211, second end 212, and slat body 215 and spaced at regular intervals along the slat length 213.

In some implementations, the slats 210 may be substantially open frame (sometimes referred to as a grille, security grille, coiling grille, or by similar terms). For example, each slat may be formed of bars running laterally across the cover, with adjacent bars connected by short longitudinal segments, and joined via joints with one rotational degree of freedom (e.g. hinge or pin joints).

Figure 9A:
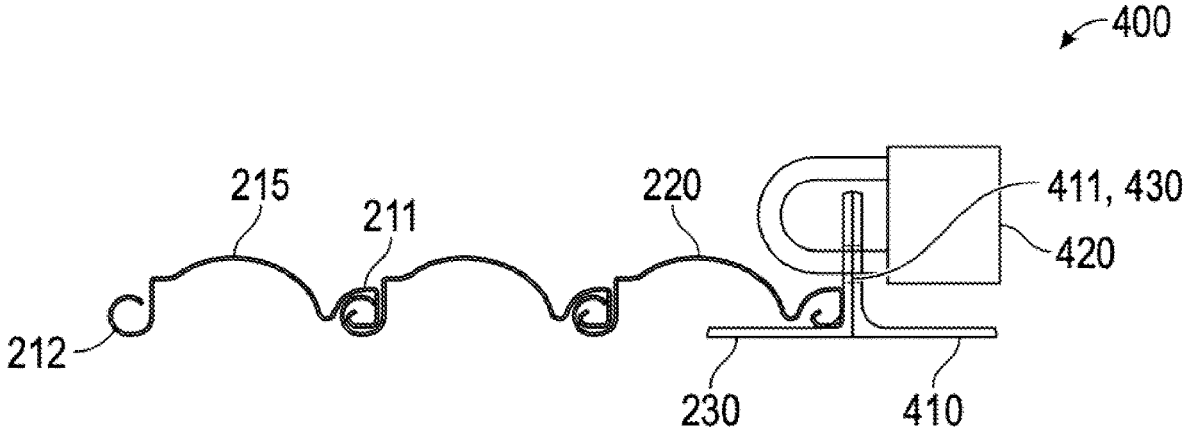
FIGS. 9A-9B show various embodiments of a locking mechanism of the roll-off container cover of FIG. 1, according to an exemplary embodiment.
Figure 9B:
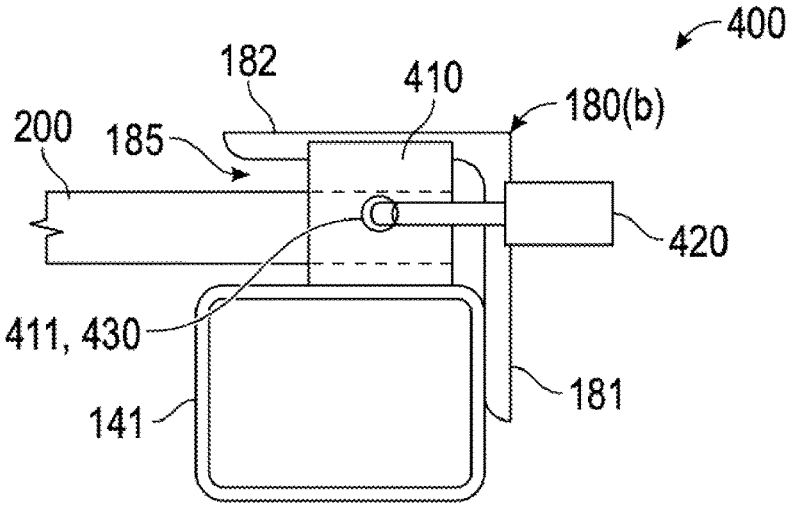

Referring now to FIGS. 9A-9B, various embodiments of a locking mechanism 400 are shown. The roll-off container cover 100 may include a locking mechanism 400 adapted to secure the cover 200 in a deployed position to prevent unauthorized access to the roll-off container 110, according to one embodiment. The locking mechanism 400 may include an anchor plate 410 and a lock device 420. The anchor plate 410 may be coupled to the top rail 121 of the back wall 120 of the roll-off container 110, according to one embodiment. In such embodiments, the anchor plate 410 may be a length of commercially-available angle iron or similar structure that is welded or fastened to the top rail 121 and arranged perpendicularly to the first and second side walls 130, 140 at the top 170 of the roll-off container 110. When so arranged, the anchor plate 410 may be substantially coplanar to the cover 200 and cover envelope 185. According to the embodiment shown in FIG. 9A, the anchor plate 410 may abut the handle 230 of the cover 200 when the cover 200 is in a deployed position. In this embodiment, the handle 230 may define a locking mechanism aperture 430 formed therethrough. The locking mechanism aperture 231 may correspond with an anchor plate aperture 411 defined by the anchor plate 410. The lock device 420, which may be a pad lock, combination lock, or some other locking device, securely couple the handle 230 to the anchor plate 410 by, for example, securing a shank or shackle of the lock device 420 through the corresponding apertures 231, 411.

In another embodiment, as shown in FIG. 9B, the anchor plate 410 may be coupled to the top rail 131 of the first side wall 130, to the top rail 141 of the second side wall 140, or to both top rails 131, 141. Furthermore, the anchor plate 410 may be coupled to the cover track assembly 180, namely to the first cover track 180(*a*) and the second cover track 180(*b*). In this embodiment, the anchor plate 410 may not extend across the back wall 120 of the roll-off container 110, but may instead only extend along a portion of the top rails 131, 141. Like the embodiment shown in FIG. 9A, the anchor plate 410 of the embodiment shown in FIG. 9B may further include an anchor plate aperture 411 which may receive a shank or shackle of the lock device 420 to secure the cover 200 in a deployed position.

In yet other embodiments not shown, the locking mechanism 400 may further prevent the cover 200 from retracting once the cover 200 has reached a fully deployed position. The locking mechanism 400 may prevent movement of the cover 200 by securing the cover 200 at a position proximate to the back wall 120, the front wall 115, or some intermediate position on the roll-off container 110. For example the locking mechanism 400 may operate by restricting the axle 310 from rotating. Specifically, the axle 310 may be coupled to the support brackets 320 using selective one-way bearings configured to facilitate rotation of the axle 310 in one direction (i.e. to deploy the cover 200) while selectively preventing rotation of the axle 310 in a second direction (i.e. to retract the cover 200). For example, a sprag-type or clutch-type one-way bearing may be used to permit free-rotation of the axle 310 in one rotational direction, but prevent or substantially inhibit rotation of the axle 310 in another direction when a movement or movements of the bearing engages with a sprag of the bearing. In this way, once the cover 200 is deployed over the cavity 160, the one-way bearing may prevent the retraction of the cover 200 and thereby prevent unauthorized access. In such embodiments, the one-way bearing may selectively prevent rotation of the axle 310 in a direction via a movable clutch mechanism, where the clutch mechanism can be selectively disengaged to subsequently permit rotation in the direction.

Although primarily described in connection with a roll-off container 110, in various embodiments, the systems and methods discussed herein may be applied to any container or structure to incorporate a retractable and lockable cover. Additionally, although primarily described as an intact or complete assembly, in many implementations, the cover assembly may be manufactured or provided separately and may be installed onto a container. For example, a container may be provided; tracks may be coupled (e.g. welded, bolted, screwed, or otherwise fastened) to sides of the container; and a cover may be inserted within an envelope defined by the tracks. Other features may be similarly added to the provided container (e.g. actuation mechanisms, locking mechanisms, etc.). Accordingly, one or more of the system components may be separately manufactured, provided, and/or installed.

In some implementations, slip linkages may be used to attach a terminal portion or end of the cover to a rotatable element or axle to. Implementations of these linkages provide connections between elements with at least one translation degree of freedom, sometimes referred to as a prismatic joint or slider or telescopic joint. Such implementations may be utilized in connection with covers for roll-off containers or dumpsters, such as retractable container covers. In many implementations, the cover may be supported at lateral edges by support rails, but may not be otherwise supported across the longitudinal end of the cover; accordingly, one or more slip linkages may be attached between the end of the cover and the rotatable element or axle along the width of the cover (e.g. one in the middle, two equally spaced linkages, three equally spaced linkages, etc.). These linkages may prevent the middle of the cover from sagging, for example. Slip linkages may be used to reduce friction, for example, as the cover is deployed or retracted: as the cover is rolled around the rotatable element or axle, the radius of the roll may change (e.g. as a helix or spiral). By varying the length of the slip linkages, the rolled portion of the cover may be fully supported by the axle regardless of the extent that the cover has been deployed or retracted.

Figure 13A:
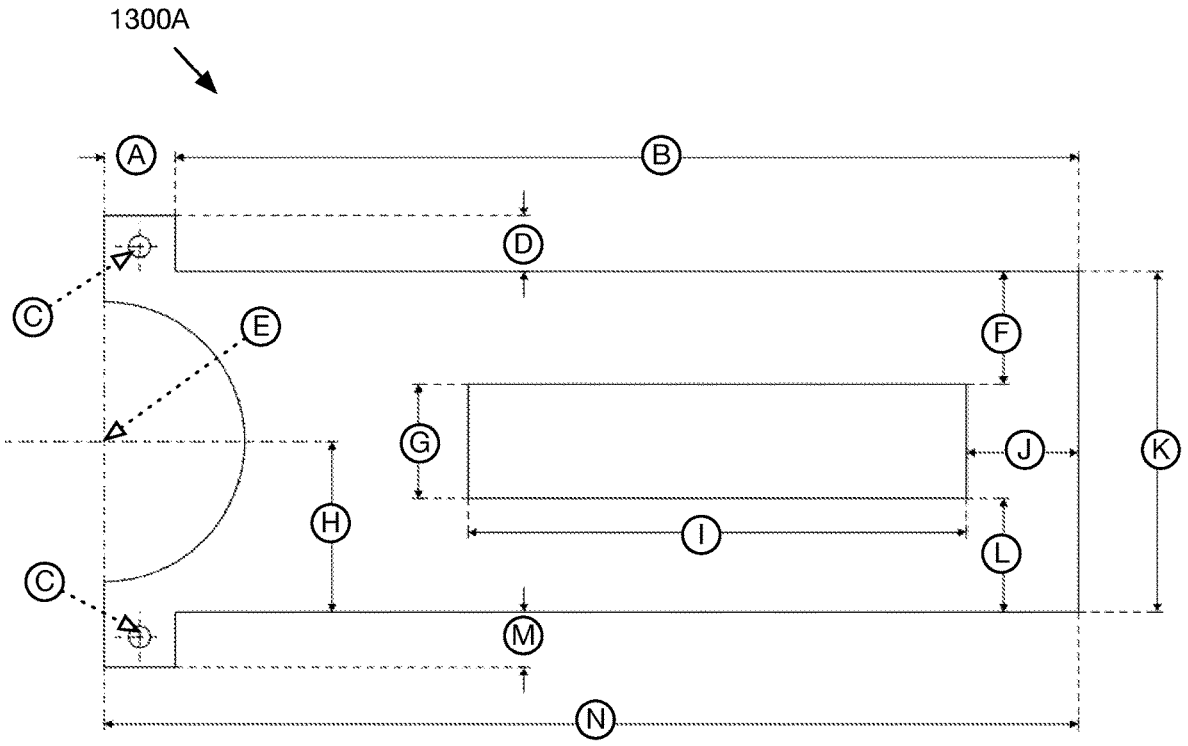
FIGS. 13A-13C are plan views of components of an implementation of a three-part slip link, according to an exemplary embodiment.
Figure 13B:
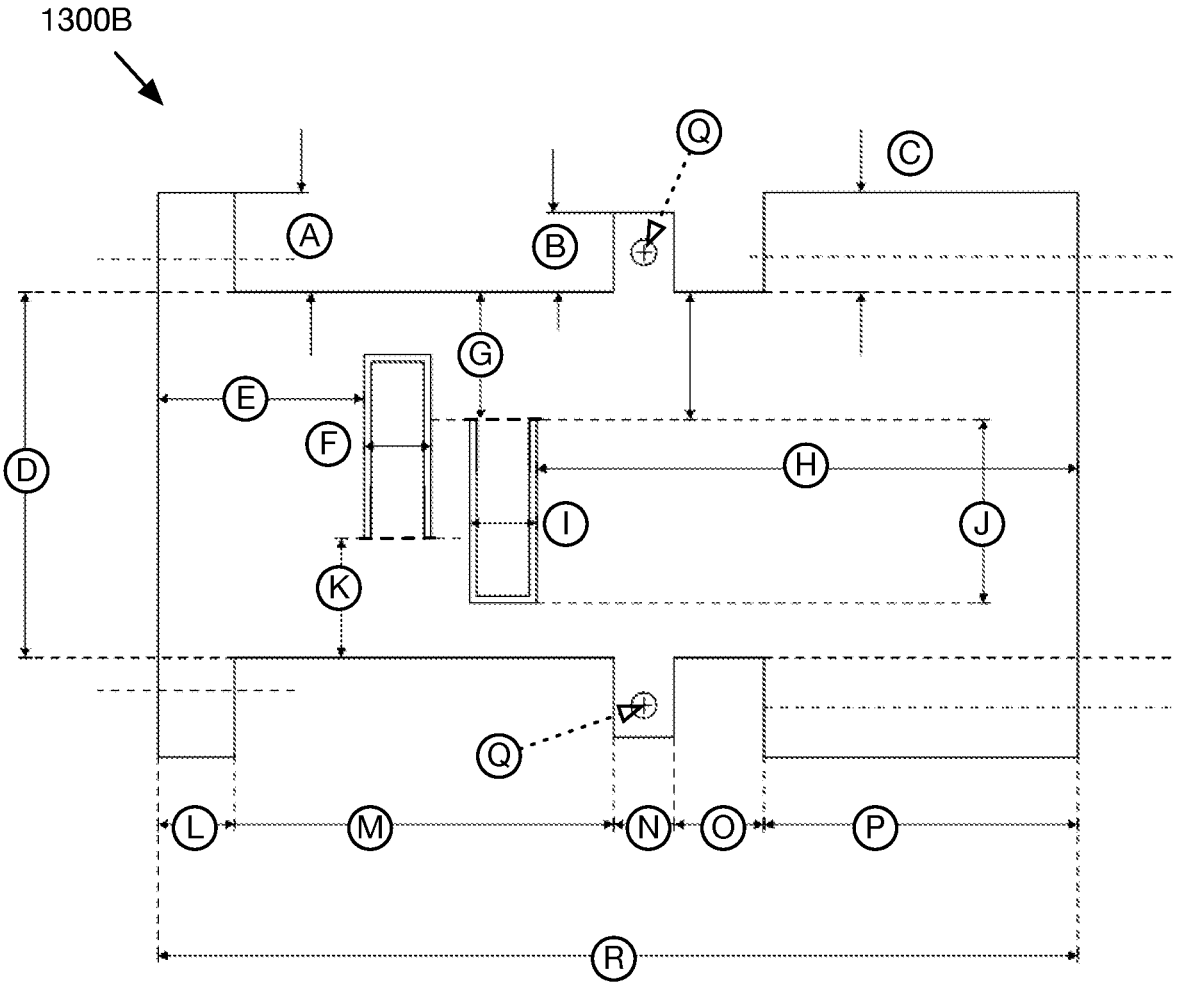
Figure 13C:
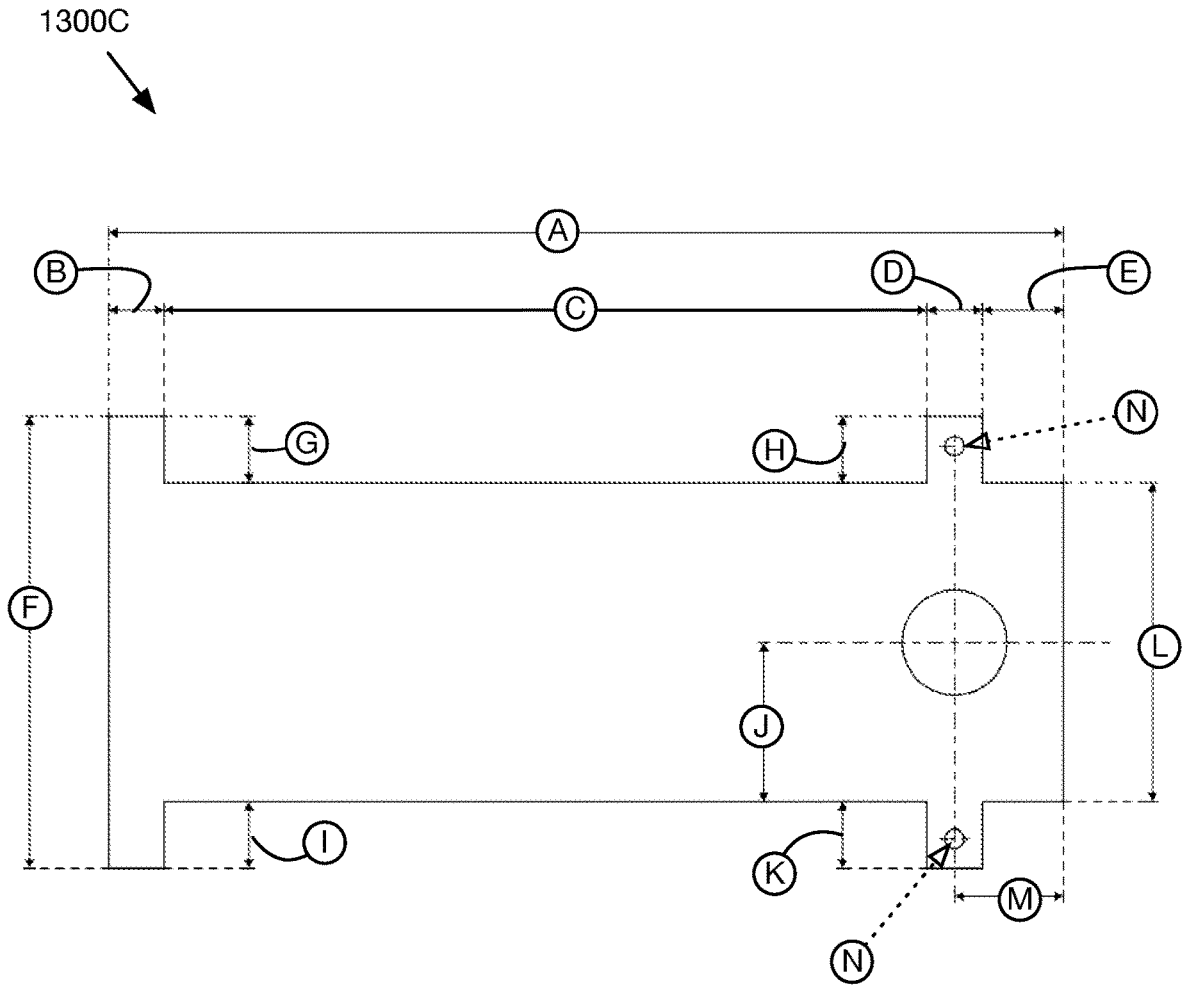

FIGS. 13A-13C are plan views of components 1300A-1300C of an implementation of a three-part slip link. Examples of the identified dimensions are listed below for example purposes only: implementations of the components may be scaled up or down, stretched in one or more directions, or otherwise modified, and accordingly, the specific dimensions included should not be considered to limit the scope of this disclosure.

| FIG. 13A (identifier) | Example measurement |
|---|---|
| A | 5/16" |
| B | 4 1/16" |
| C | 3/32"ϕ |
| D | 1/4" |
| E | 5/8" R |
| F | 1/2" |
| G | 1/2" |
| H | 3/4" |
| I | 2 1/4" |
| J | 1/2" |
| K | 1 1/2" |
| L | 1/2" |
| M | 1/4" |
| N | 4 3/8" |

| FIG. 13B (identifier) | Example measurement |
|---|---|
| A | 3/8" |
| B | 5/16" |
| C | 3/8" |
| D | 1 1/2" |
| E | 7/8" |
| F | 5/16" |
| G | 17/32" |
| H | 2 3/16" |
| I | 5/16" |
| J | 3/4" |
| K | 17/32" |
| L | 5/16" |
| M | 1 9/16" |
| N | 1/4" |
| O | 3/8" |
| P | 1-14" |
| Q | 3/32"ϕ |
| R | 3 3/4" |

| FIG. 13C (identifier) | Example measurement |
|---|---|
| A | 4 1/2" |
| B | 1/4" |
| C | 3 5/8" |
| D | 1/4" |
| E | 3/8" |
| F | 2" |
| G | 1/4" |
| H | 5/16" |
| I | 1/4" |
| J | 3/4" |
| K | 5/16" |
| L | 1 1/2" |
| M | 1/2" |
| N | 3/32"ϕ |

In the illustrations of FIGS. 13A-13C, double lines represent cut lines. For example, in FIG. 13B, the illustrated part 1300B includes two thin U-shaped cuts. These cuts may have any interior dimension, such as 1/16", 1/32", 1/8", etc. Additionally, in the illustrations dashed lines represent folding lines. For example, in FIG. 13B, portions of the component 1300B extending above and below the central body (e.g. near measurements A and L) may be bent 90 degrees at each dashed line, such that a terminal end of each portion is parallel and adjacent to the central body (e.g. above or below, separated by an amount corresponding to the distance between the two dashed lines). These bended portions may form a retaining structure preventing lateral motion of components 1300A or 1300C when the three-part slip link is assembled. Accordingly, the illustrations show the components flat or before bending. Although shown flat, in some implementations, the components may be manufactured with the bended portions in place. In other implementations, the components may be manufactured flat as shown (e.g. stamped or cut from sheet metal, laser cut, cut with an abrasive water jet, etc.).

Figure 14A:
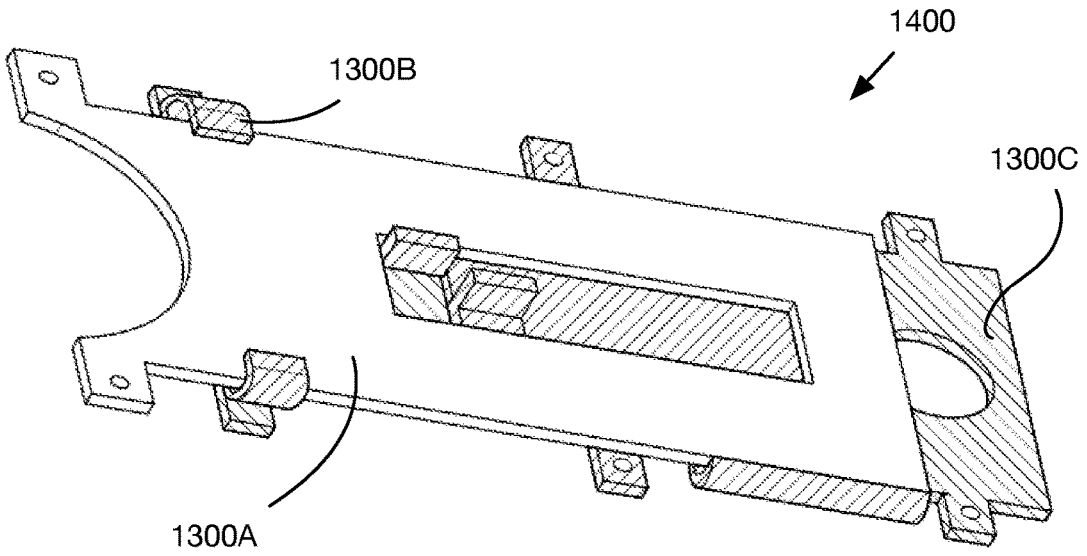
FIGS. 14A-14B are perspective and side illustrations of an implementation of a three-part slip link, according to an exemplary embodiment.
Figure 14B:
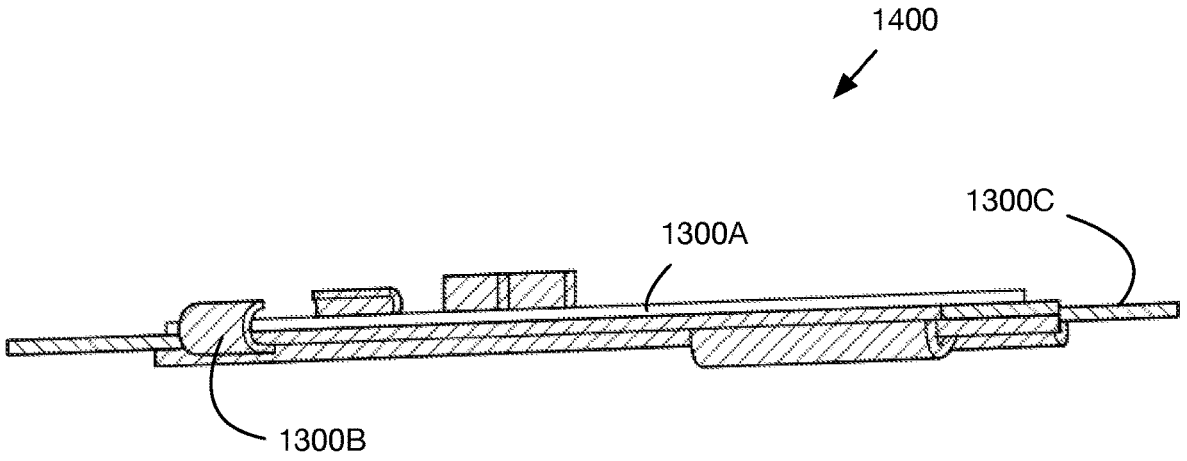

FIGS. 14A-14B are perspective and side illustrations of an implementation of a three-part slip link 1400. For example, the three-part slip link 1400 may be assembled from implementations of the components 1300A-1300C of FIGS. 13A-13C. As shown, the bent portions of the middle element 1300B may be used to slidingly retain elements 1300A and 1300C. Similarly, a cutout or horizontal slot in component 1300A may accommodate bent portions of element 1300B or 1300C, allowing a single translational degree of freedom. Thus, the three-part slip link 1400 may be retracted or extended between a first position and second position along a longitudinal axis with one translational degree of freedom.

Figure 14C:
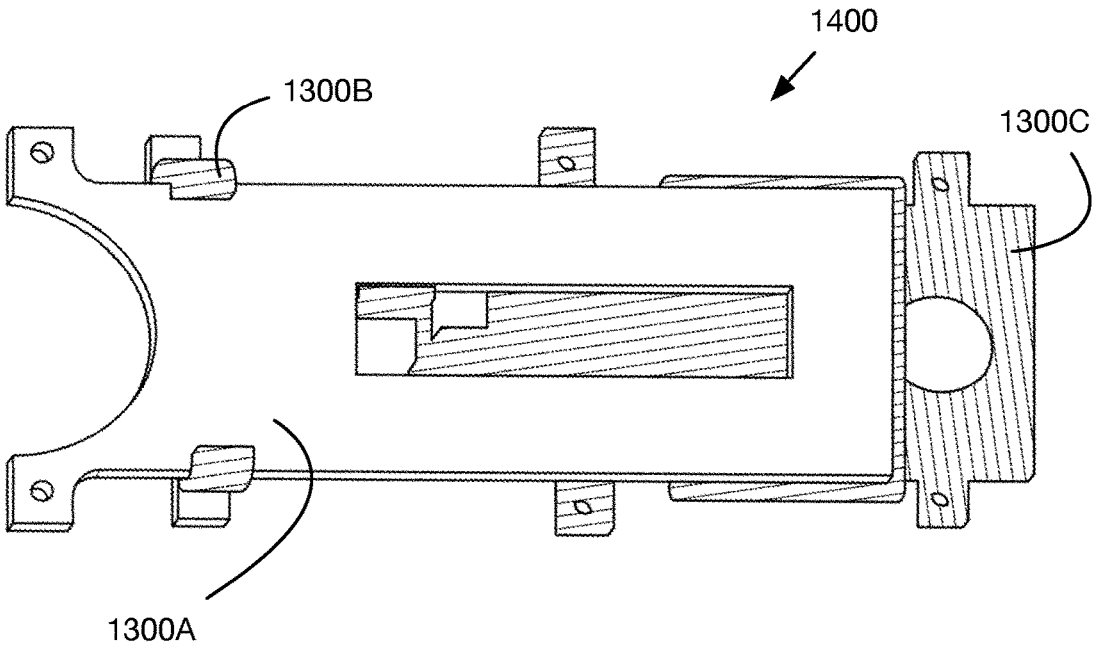
FIGS. 14C-14E are front illustrations of an implementation of a three-part slip link, in retracted or closed configuration, with a first portion extended, and with a second portion extended, respectively, according to an exemplary embodiment.
Figure 14D:
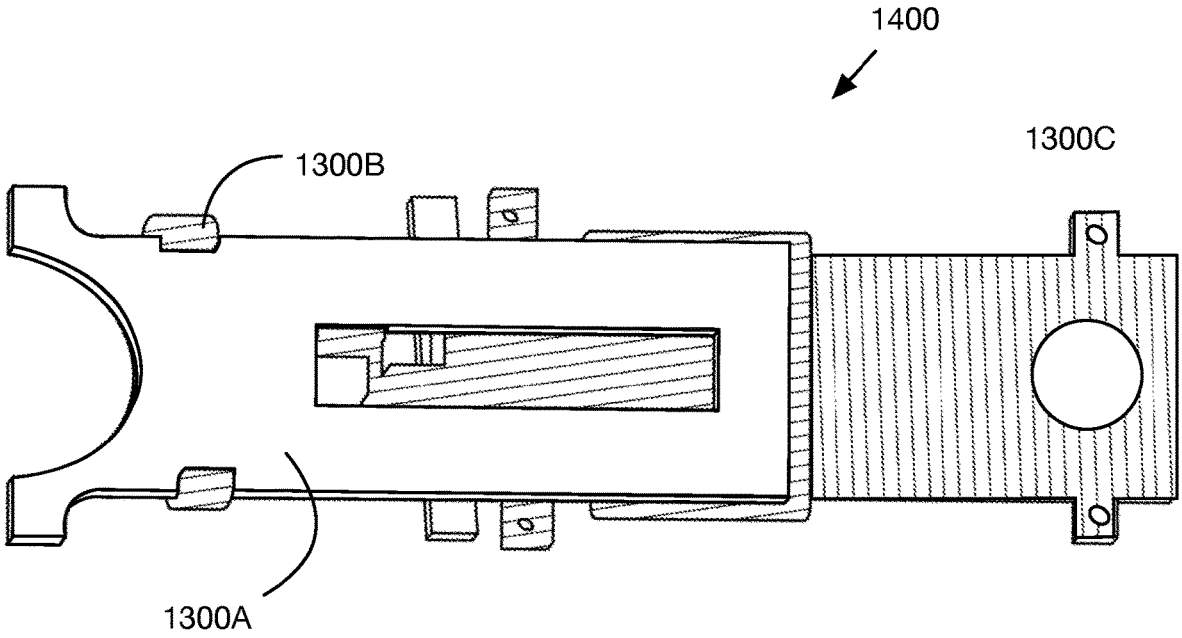
Figure 14E:
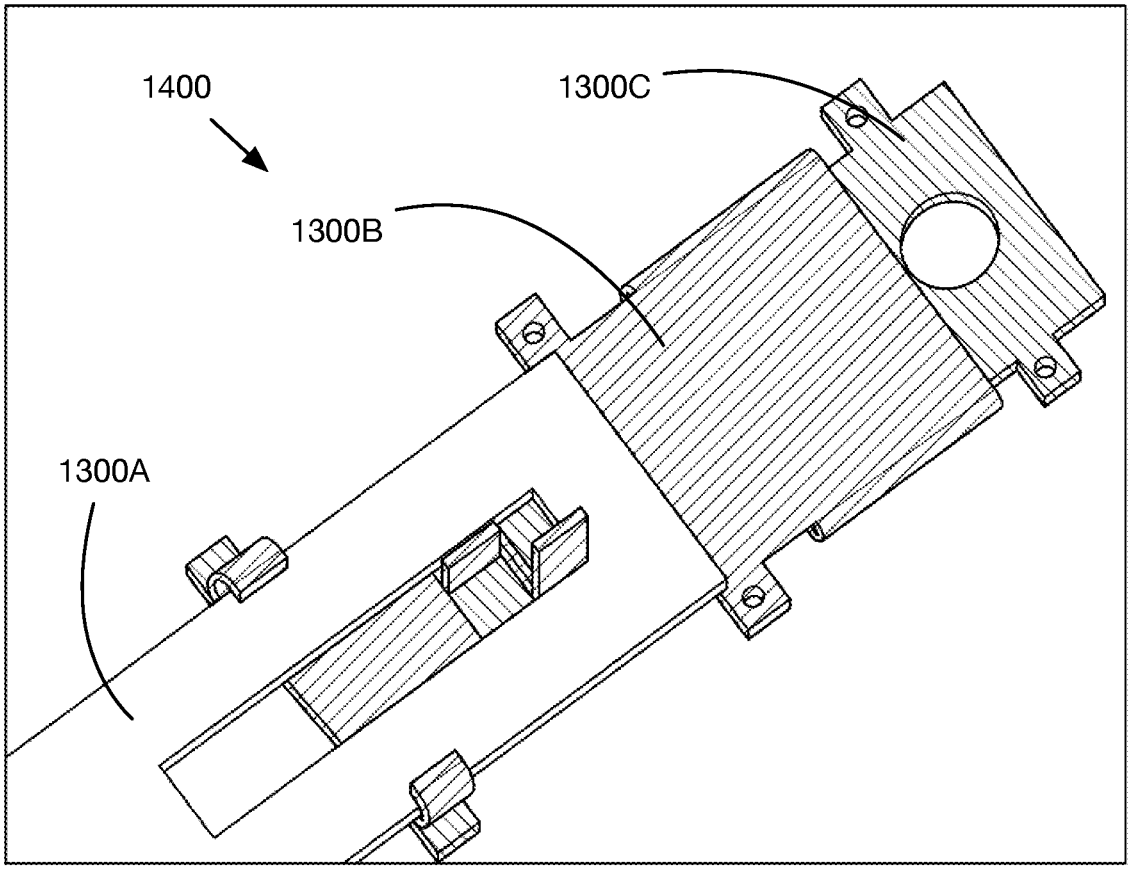

FIGS. 14C-14E are front illustrations of the implementation of the three-part slip link of FIGS. 14A-14B 1400, in retracted or closed configuration (FIG. 14C), with a first portion extended (FIG. 14D), and with a second portion extended (FIG. 14E), respectively. Although shown separately extended, in some implementations, both portions may be extended simultaneously.

Figure 15A:
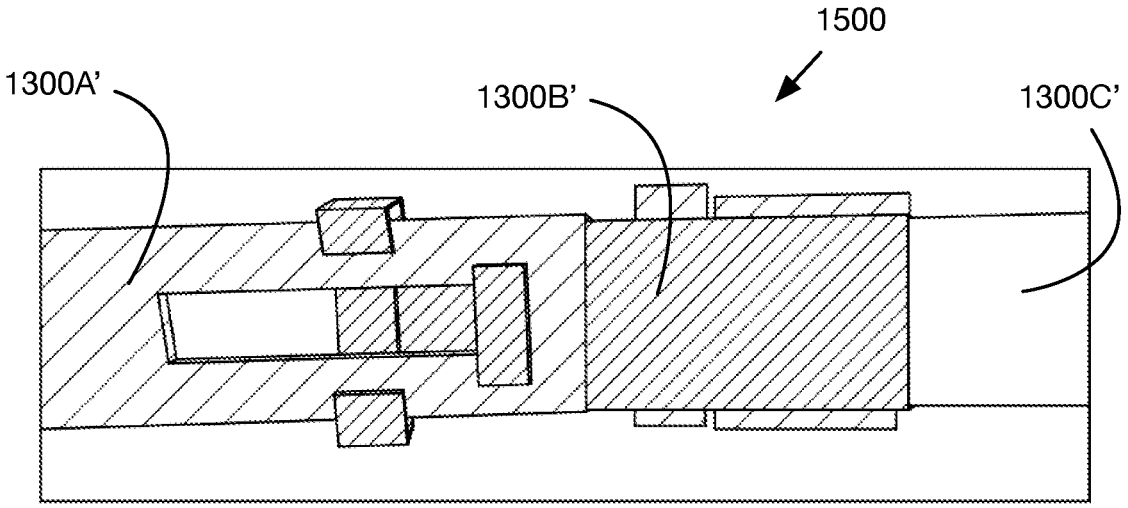
FIGS. 15A-15B are illustrations of an implementation of a three-part slip link from a front view in extended and retracted positions respectively, according to an exemplary embodiment.
Figure 15B:
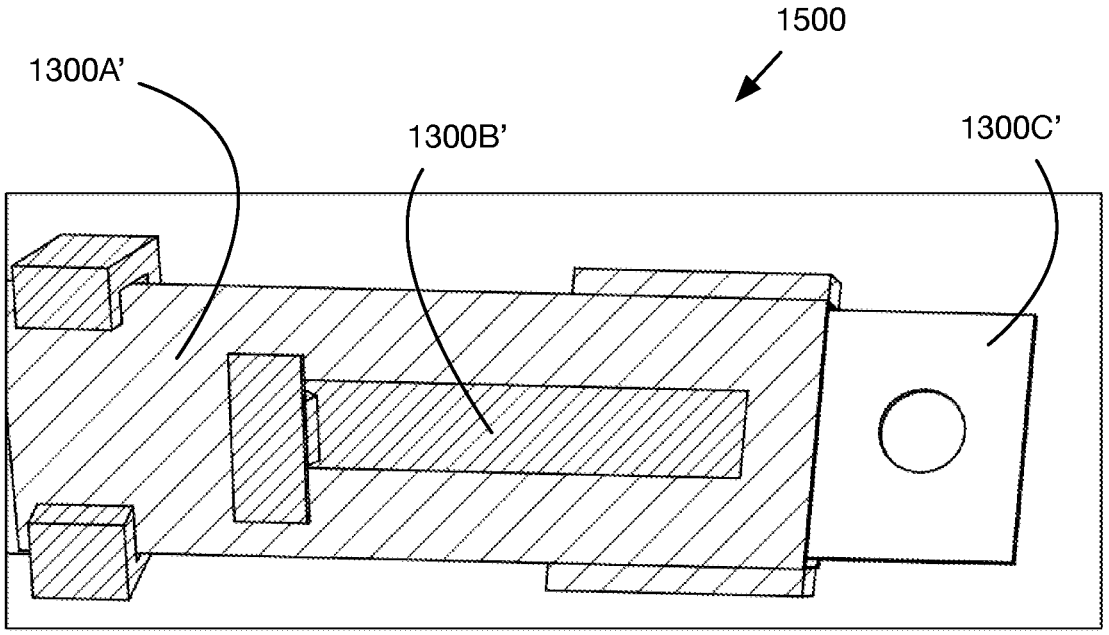
Figure 15C:
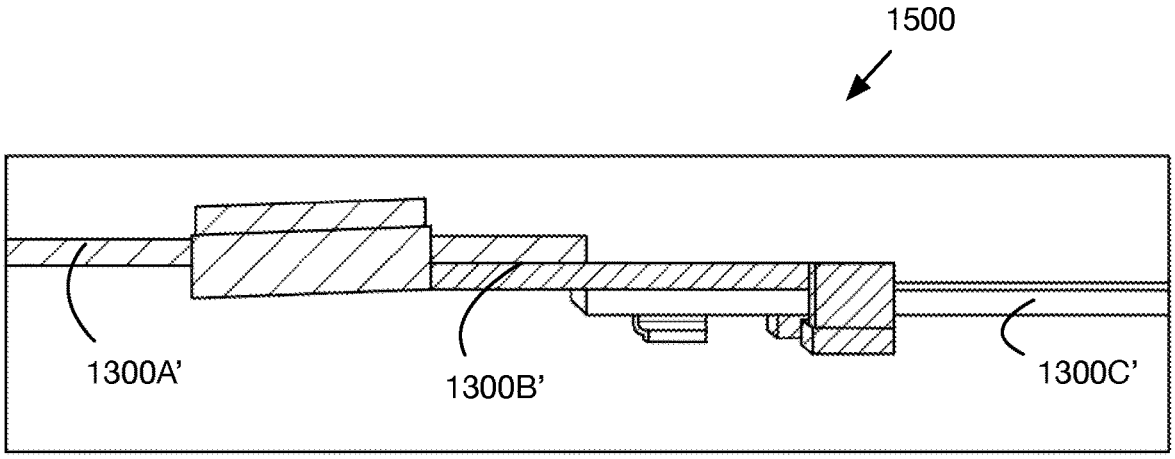
FIGS. 15C-15D are illustrations of an implementation of a three-part slip link from a side view in extended and retracted positions respectively, according to an exemplary embodiment.
Figure 15D:
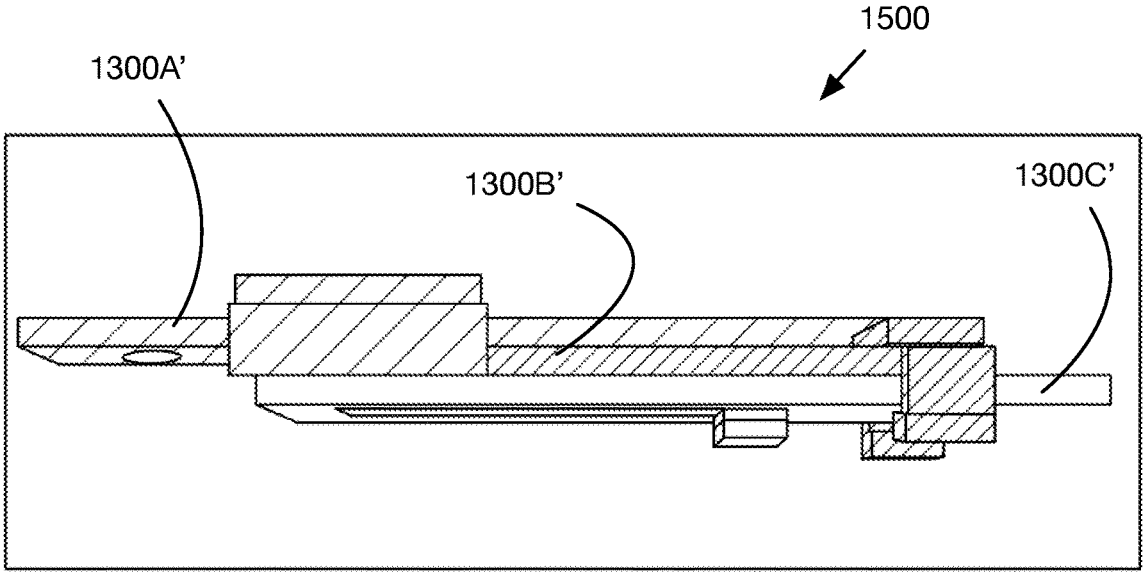

FIGS. 15A-15B are illustrations of another implementation of a three-part slip link 1500 from a front view in extended and retracted positions respectively. The link may be formed from components similar to those illustrated in FIGS. 13A-13C, e.g. 1300A'-1300C'. Components 1300A'-1300C' may include retention elements to similarly prevent rotation or translation in directions other than a longitudinal axis of the slip link. FIGS. 15C-15D are illustrations of an implementation of the three-part slip link 1500 from a side view in extended and retracted positions respectively.

Figure 16A:
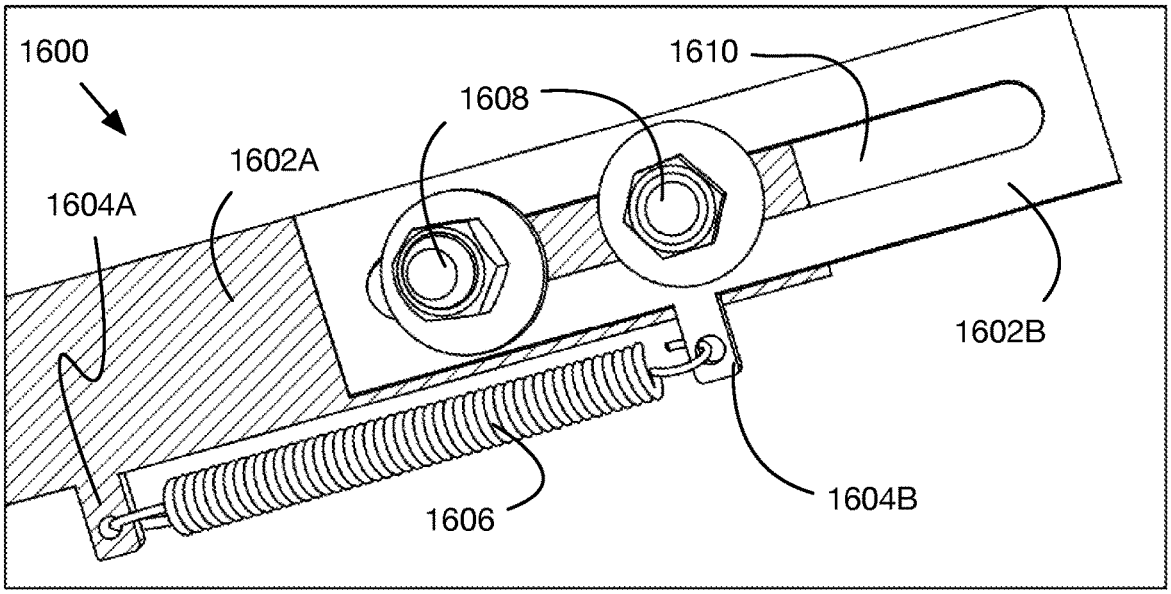
FIGS. 16A-16C are illustrations of an implementation of a two-part slip link from a front view, side view, and rear view, respectively, according to an exemplary embodiment.
Figure 16B:
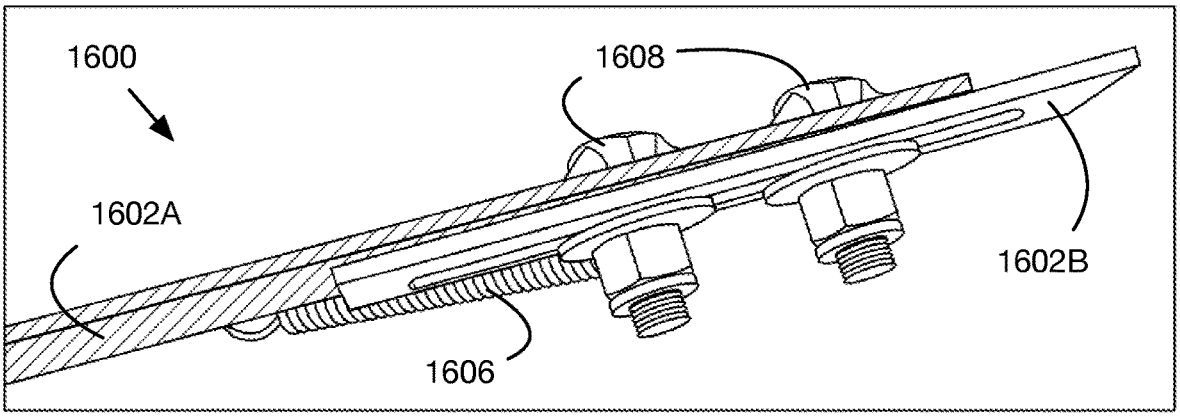
Figure 16C:
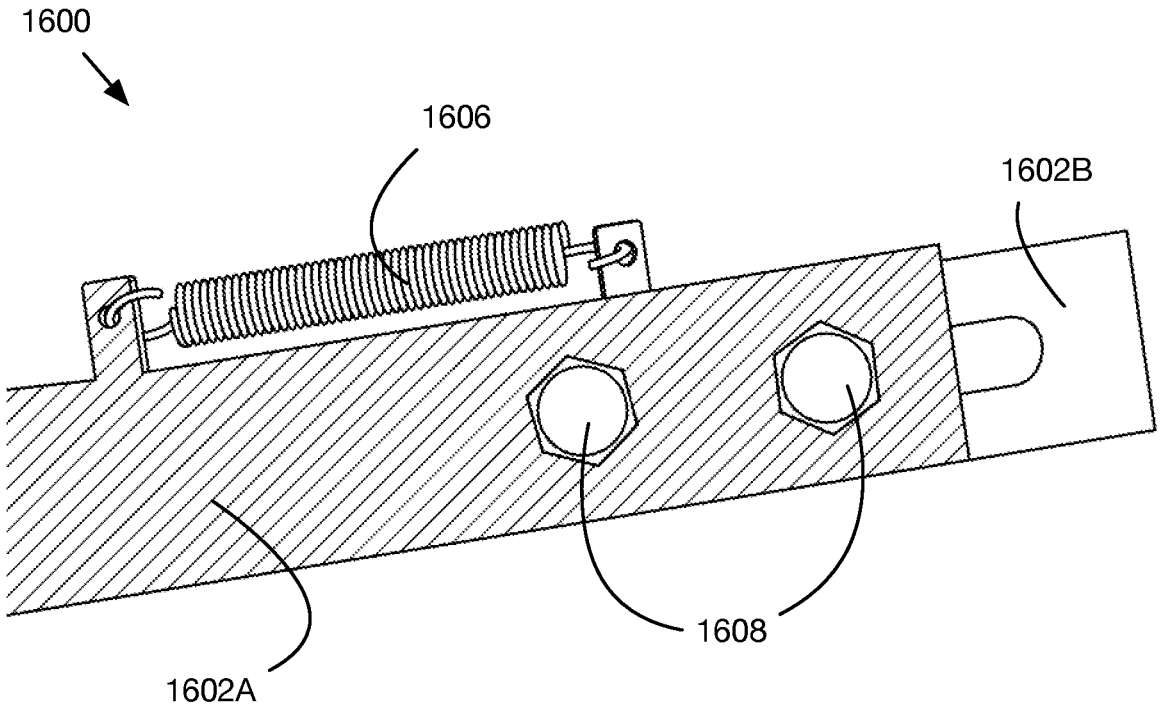

In some implementations, a slip link may be formed from fewer components. For example, FIGS. 16A-16C are illustrations of an implementation of a two-part slip link 1600 from a front view, side view, and rear view, respectively. In the implementation shown in FIGS. 16A-16C, a spring 1606 is included to provide a retraction force (e.g. opposing extension of the link). The spring 1606 is attached between tabs 1604A and 1604B on element 1602A and 1602B, respectively. To constrain motion, in some implementations, bolts 1608 or similar sliding elements may connect to element 1602 and slidingly engage with a slot 1610 in element 1602B.

The slip links of FIGS. 13A-16C may be made of steel, aluminum, wood, plastic, or any other such material, and may have any material thickness (e.g. ⅛" steel, ¼" aluminum, etc.).

In some implementations, a slip link may be used as part of a retractable cover system for a container, such as a roll-off container or dumpster. For example, the cover system may include a cover comprising a plurality of interlocking slats, and the slip link may be used to join or support adjacent slats while allowing a degree of freedom in translation. This may enable retraction and extension of the cover, including mechanisms in which the cover is rolled around a spiral or other retainer mechanism when retracted.

Figure 17:
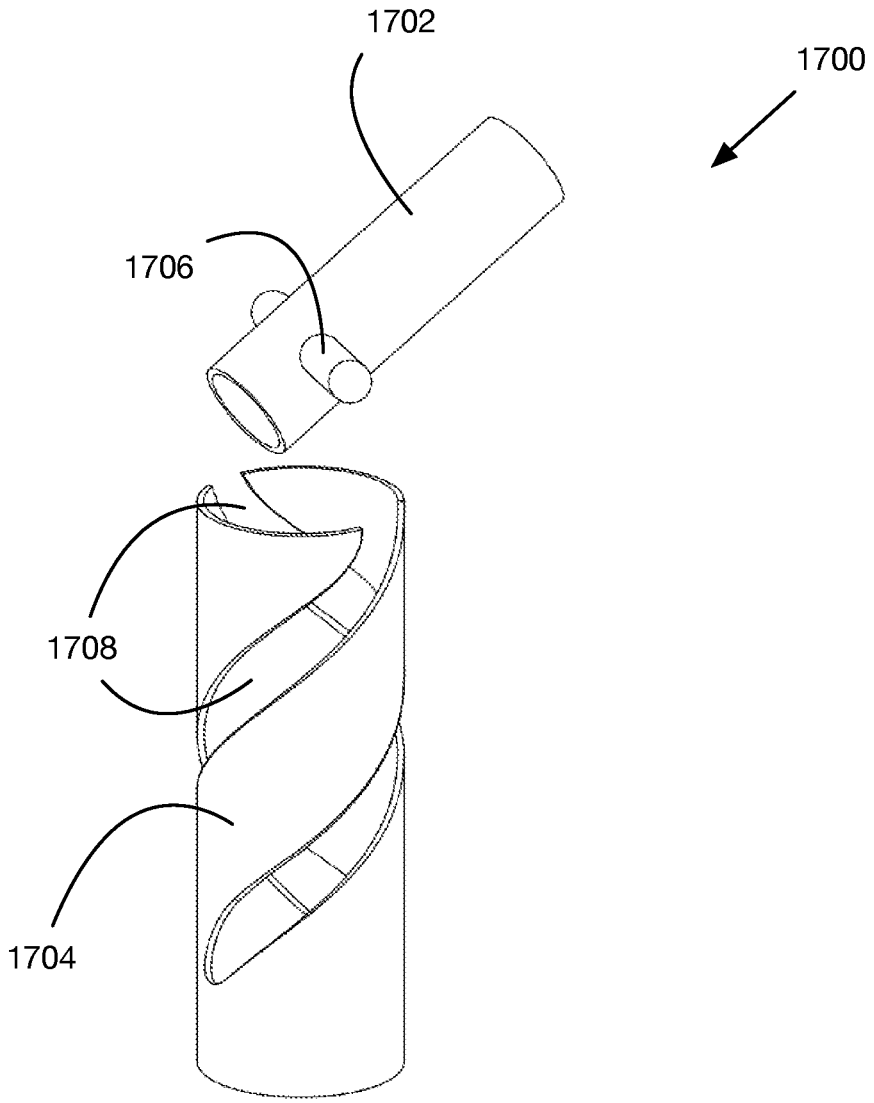
FIG. 17 is an illustration of an implementation of a helical cam pin and slot linkage, according to an exemplary embodiment.

FIG. 17 is an illustration of an implementation of a helical cam pin and slot linkage 1700, according to some implementations. The linkage may comprise cam 1702 with horizontal pin 1706, which is configured to engage with helical slots 1708 of linkage 1704 with one combined translational and rotational degree of freedom (e.g. simultaneous translation and rotation along the helix of slots 1708). Although shown with slots 1708 extending through the end of linkage 1704, in many implementations, the slots may be closed or not extend fully to the end of linkage 1704 (thereby retaining pin 1706 from removal).

In many implementations, cam pin and slot linkage 1700 may be utilized instead of a linear slip linkage. For example, in one such implementation, one or more cams 1702 may be connected to an axle or shaft around which a cover is to be rolled. To allow the cams 1702 to rotate as the cover is retracted or deployed (and thereby allow each cam pin and slot linkage 1700 to extend or retract), the cams 1702 and/or linkage 1704 may be attached to the axle and/or cover via a connection with at least one degree of rotational freedom (e.g. an axial pin joint, a ball and socket joint, etc.).

Although shown with slots 1708 open in linkage 1704, in many implementations, slots 1708 may comprise grooves on an inside wall of a tubular linkage 1704 (e.g. similar to rifling in a barrel). In such implementations, pins 1706 may not protrude through linkage 1704, but instead be slidingly engaged within the rifling or grooves 1708. Such implementations may prevent or reduce the intrusion of dust or debris.

Figure 18A:
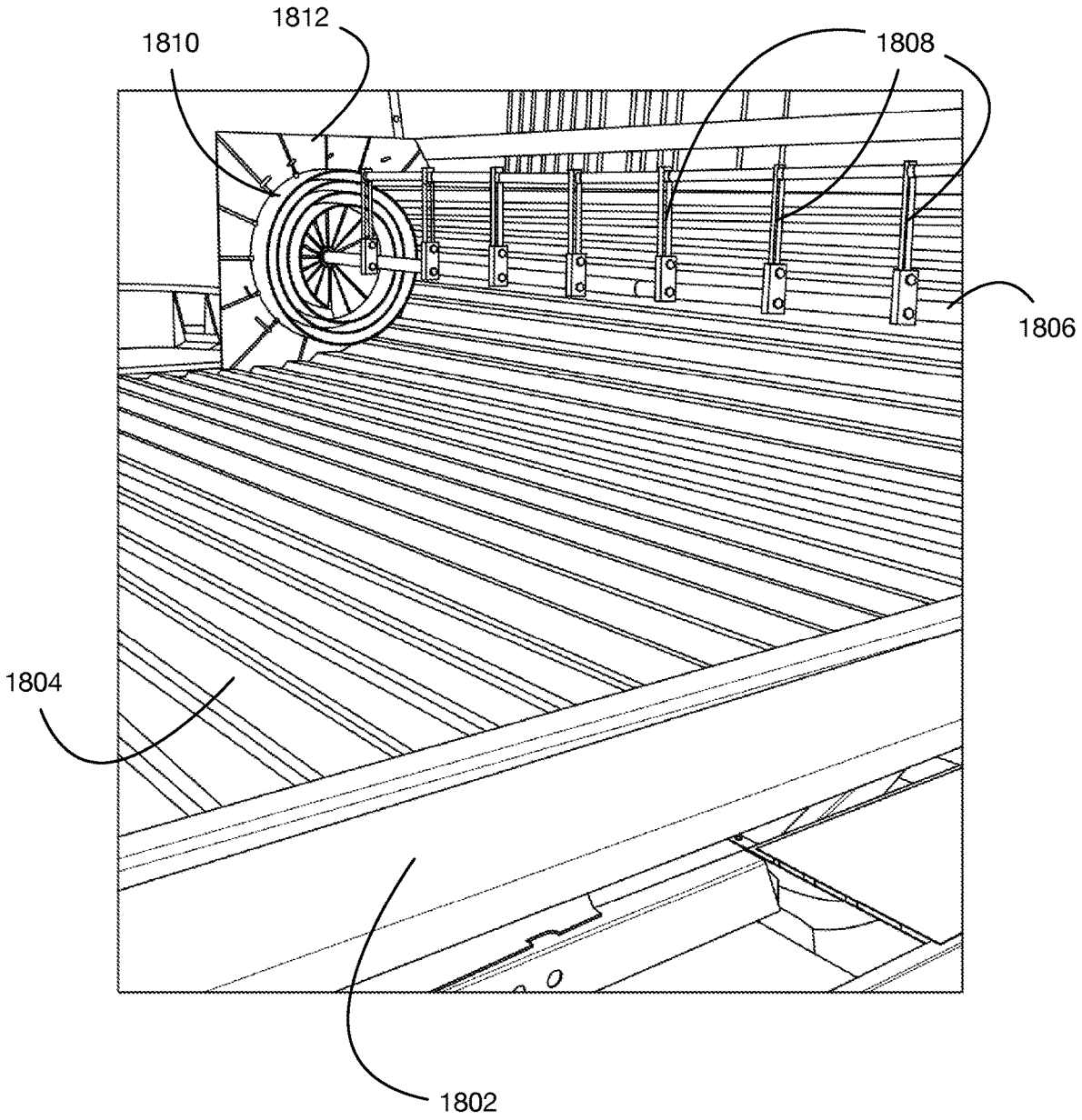
FIG. 18A-18C are illustrations of an implementation of a retractable container cover utilizing slip linkages, according to an exemplary embodiment.
Figure 18B:
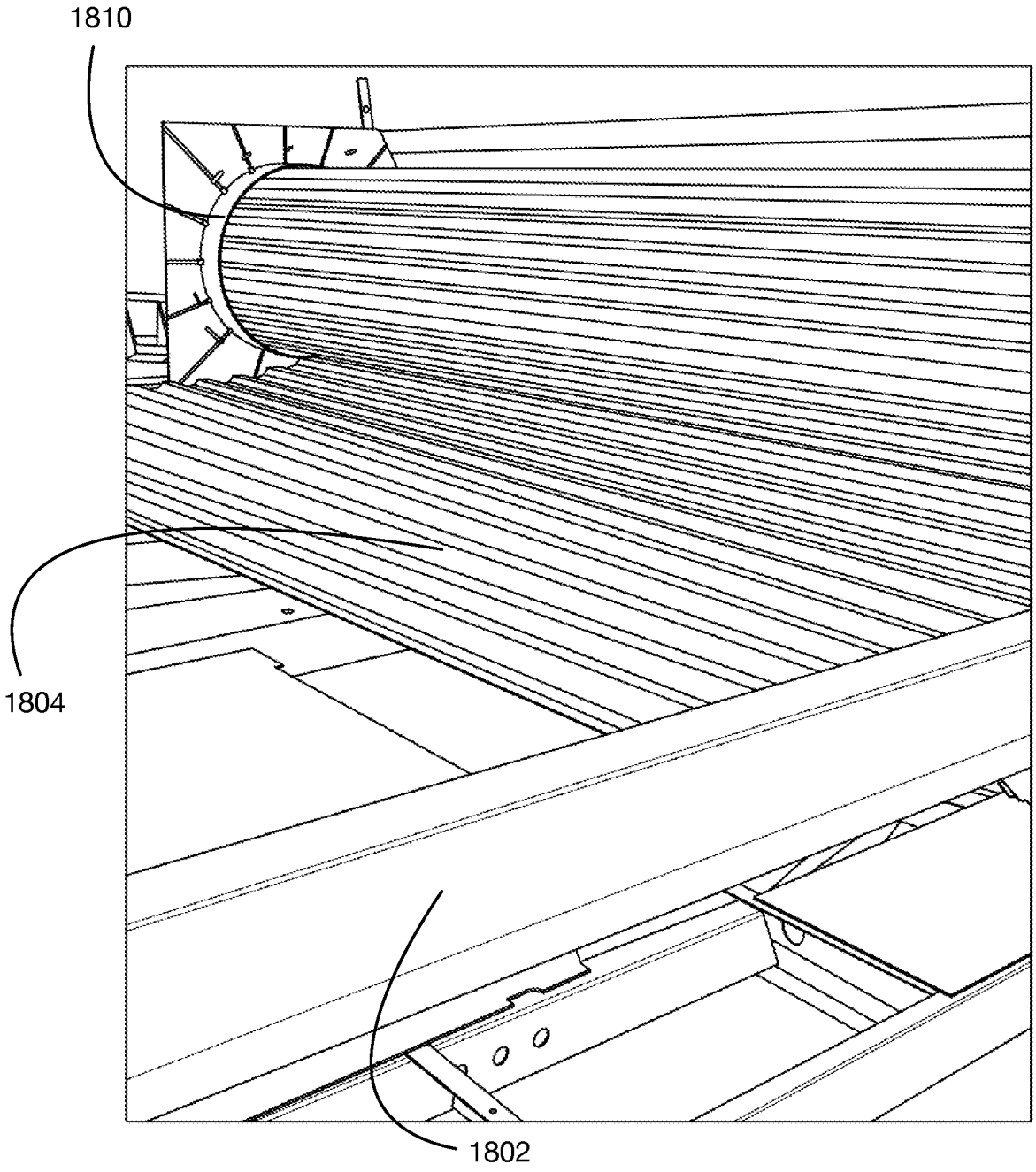
Figure 18C:
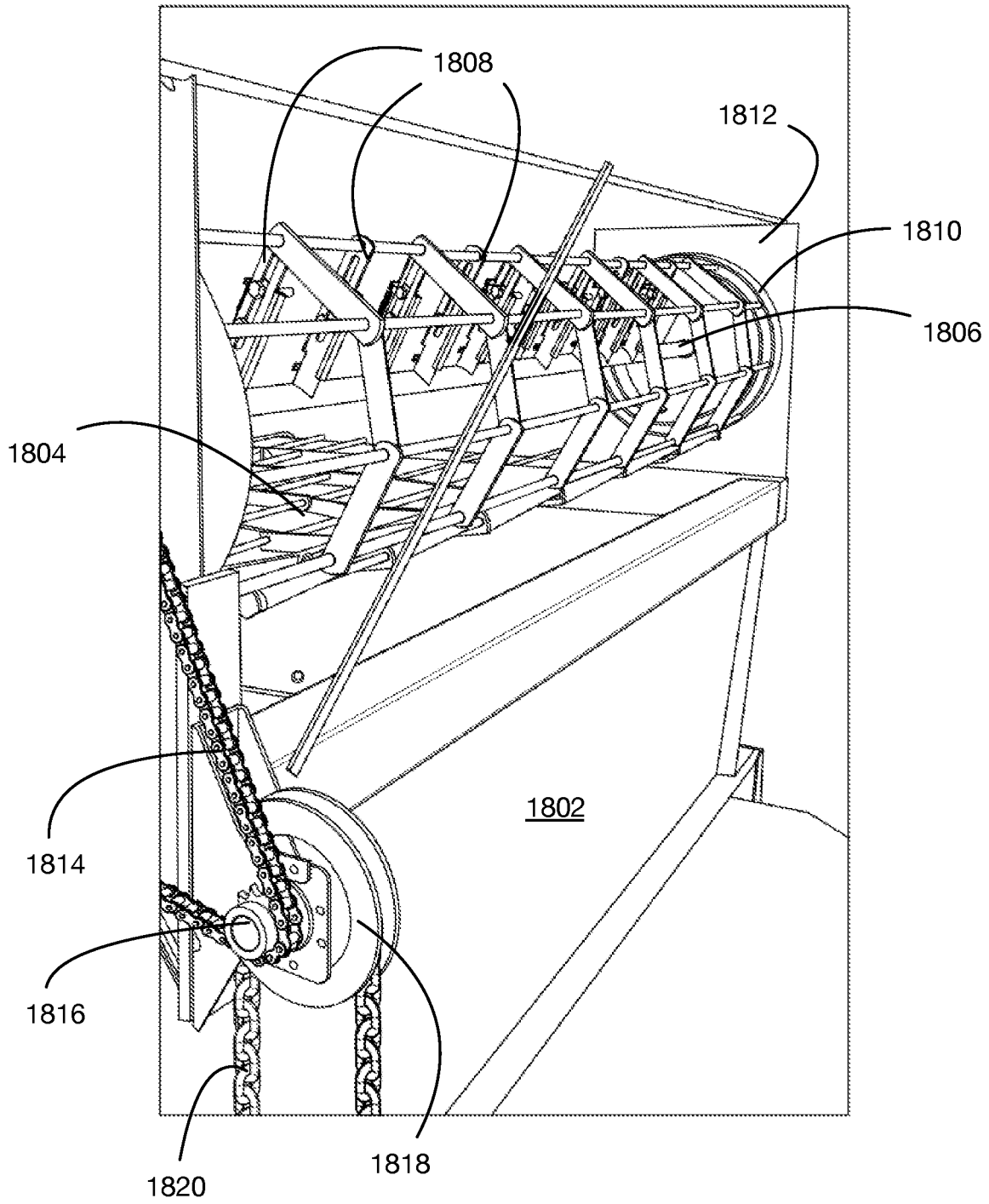

FIG. 18A-18C are illustrations of an implementation of a retractable container cover utilizing slip linkages, according to an exemplary embodiment. Referring first to FIG. 18A, illustrated is a perspective view of a roll off container 1802 with retractable cover 1804 in a deployed (or mostly deployed) position. The cover 1804 may be retracted to the right in the illustration onto a spool around axle 1806. As shown, axle 1806 may be affixed to side or end plate 1812. To keep cover 1804 from binding as it is retracted, side or end plate 1812 may include a spiral guide 1810. As the cover 1804 is rolled around the axle 1806, it may follow spiral guide 1810 with a decreasing radius of curvature until the cover is fully retracted. To support the cover 1804 along axle 1806, one or more slip linkages 1808 (which may comprise implementations of any of the slip linkages discussed above) may support a terminal portion (and/or adjacent portions) of cover 1804 between side or end plate 1812 and an opposing end plate (not illustrated). Because the slip linkages 1808 have one translation degree of freedom, they may retract as the cover is retracted to correspond to the reducing radius of curvature (and extend as the cover is extended, corresponding to the increasing radius of curvature as the cover is unrolled through the spiral guide). FIG. 18B is an illustration showing the portion of the container 1802 and cover 1804 of FIG. 18A in a mostly retracted position.

Similarly, FIG. 18C is a reverse view of an implementation of a portion of a container 1802 and cover 1804. The cover 1804 has been shown as a grille type (e.g. without solid slats) to better show axle 1806, slip linkages 1808, and spiral guide 1810. In many implementations, the cover 8104 may be composed of horizontal bars as shown and may not be solid; while this may expose the contents of the container to air, rain, or other environmental effects, the resulting cover and container may be lighter, and solid containment may not be necessary in many implementations.

As shown, in the illustration of FIG. 18C, in some implementations, the cover may be retracted via chain 1814 attached to a sprocket or gear (not illustrated) on one end of axle 1806. The chain 1814 may be connected to gear 1816, which may itself connect to chain drive 1818 and chain 1820, a motor, or any similar method of driving chain 1814. One or more of the gear on the end of axle 1806, sprocket 1816, and/or drive 1818 may be ratcheting to allow free extension of the cover in some implementations.

Although shown with linear slip linkages 1808, as discussed above in connection with FIG. 17, cam pin and slot linkages may be utilized instead or in addition in some implementations. For example, a cam may be attached to an axle via a ball and socket or axial pin joint, allowing the cam to rotate. A terminal portion or slat of a cover may be attached to a slot linkage, and the cam inserted into the slot linkage such that it may rotate and retract or extend as the cover is retracted or deployed.

Other types of linkages may be utilized, without departing from the scope of the systems described herein.

Figure 19:
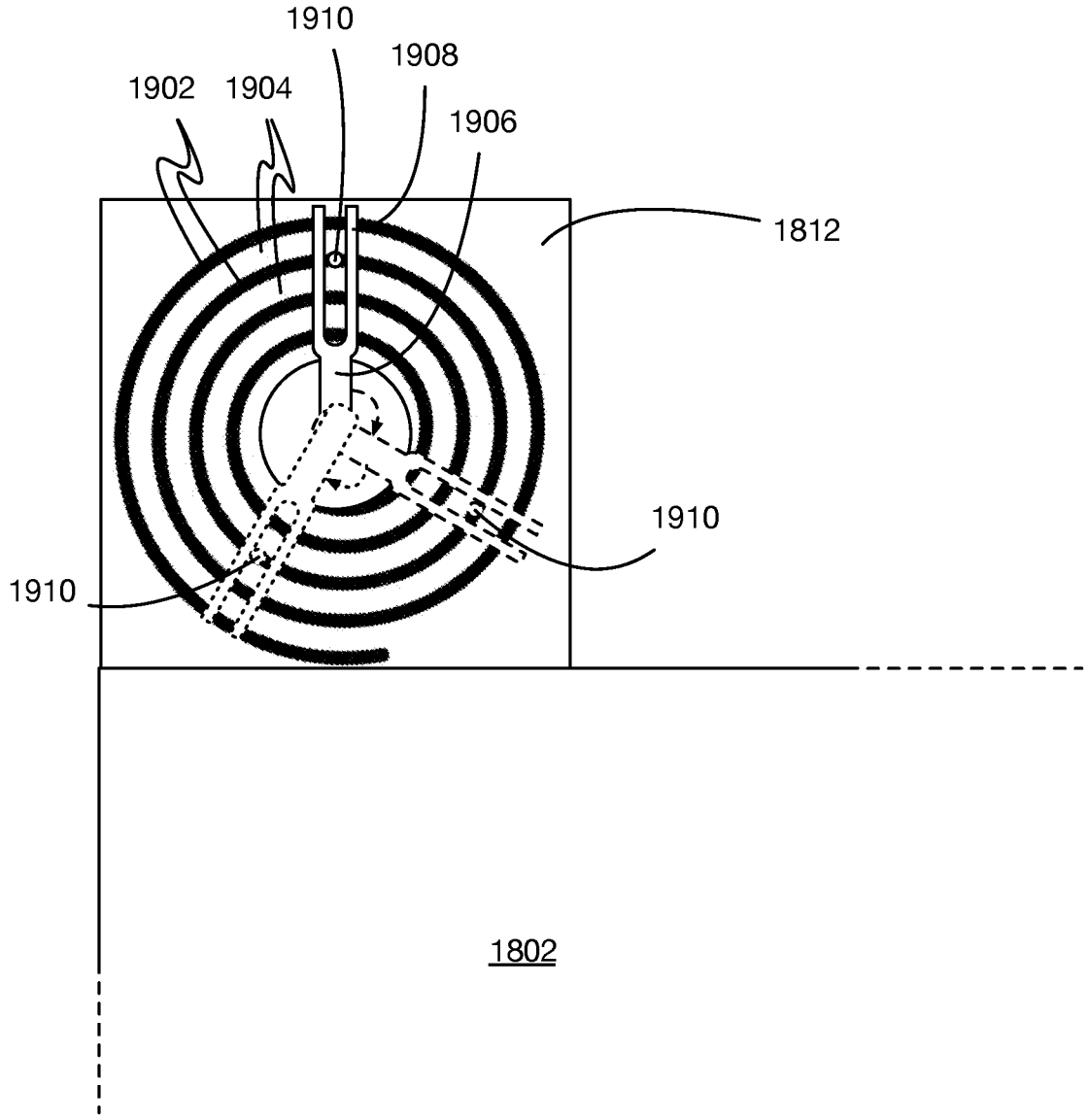
FIG. 19 is an illustration of a side view of another implementation of a retractable container cover utilizing slip linkages, according to an exemplary embodiment.

As discussed above, FIG. 18A illustrates a side or end plate 1812 and a spiral guide 1810. In some implementations, spiral guide may comprise sheet metal, bent into a spiral and welded or otherwise attached to side or end plate 1812. In other implementations, this may be replaced by a channel or groove cut into side or end plate 1812, which may be easier to manufacture and/or maintain. For example, FIG. 19 is an illustration of an embodiment of a side or end plate 1812 attached to a container 1802, viewed from an exterior view point. A cover (not illustrated) may have a terminal portion or slat with a pin or rod 1910, which may extend through a channel 1902 (shown in black) cut into side or end plate 1812 (e.g. with walls 1904, shown in white). As the cover is retracted or deployed, the pin or rod 1910 of the terminal portion or slat of the cover may follow the spiral groove or channel 1902, thereby reducing or increasing the diameter of the curve of the inner portion of the cover.

To guide the pin or rod 1910 (and thereby guide the cover), in some implementations, a yoke 1906 with slotted terminal portion 1908 may be attached to an axle (not illustrated) of the cover retaining system. As shown, the terminal portion 1908 of the yoke may provide a force tangent to the groove or channel 1902 while allowing the pin or rod 1910 to slide orthogonally, thereby following the groove or channel 1902 as its diameter increases or decreases. In FIG. 19, the yoke 1906 and pin or rod 1910 is shown in three positions (shown in solid, dashed, and dotted line); as shown, pin or rod 1910 follows the groove 1902 and gets closer to the center of the spiral as the yoke 1906 is rotated clockwise (a corresponding pin or rod in a corresponding groove in another end or side plate on the opposing side of the axle would rotate counter-clockwise). Accordingly, in such implementations, the slat or terminal portion of the cover may be supported at both ends by the groove, throughout its range of motion.

To rotate the yoke 1906, a chain 1814 and gear 1816 may be utilized as shown in FIG. 18C (omitted in FIG. 19 for clarity). The yoke 1906 may be attached to a sprocket or gear that maybe rotated by chain 1814. Referring back to FIG. 18C, in some implementations, to prevent twisting forces across the axle or cover, a second gear 1816 and chain 1814 system may be installed at the opposing end of the container (e.g. to rotate the axle from the opposite end). In some implementations, a single chain 1820 may be utilized to rotate both gears, with a secondary axle (parallel to axle 1806) connected to gear 1816 and a corresponding second gear 1816. In some implementations, such as with yokes 1906, this may reduce the number of slip linkages 1808 needed to support the cover during deployment and/or retraction.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the slip links as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed:

1. A retractable container cover system for a container, comprising:

a cover configured to be slidingly translated along a length of a top surface of the container between a deployed position and a retracted position;

one or more slip linkages connected to a first end of the cover;

a rotatable element connected to the one or more slip linkages;

a spiral guide adjacent to one end of the rotatable element, the spiral guide configured to receive a side portion of the cover when in the retracted position, wherein the cover comprises a cylindrical terminal portion extending into the spiral guide; and a yoke connected to the rotatable element comprising a slotted terminal portion engaging the cylindrical terminal portion of the cover to provide one translational degree of freedom; and wherein the cover is configured to be rolled around the rotatable element when in the retracted position.

2. The retractable container cover system of claim 1, further comprising a second spiral guide adjacent to an opposing end of the rotatable element, the second spiral guide configured to receive a second opposing side portion of the cover when in the retracted position.

3. The retractable container cover system of claim 1, wherein the one or more slip linkages have one translational degree of freedom.

4. The retractable container cover system of claim 1, wherein at least one of the one or more slip linkages comprises a first portion and a second portion slidingly engaged to the first portion.

5. The retractable container cover system of claim 4, wherein the at least one of the one or more slip linkages further comprises a third portion slidingly engaged to the second portion.

6. The retractable container cover system of claim 4, wherein the first portion of the slip linkage is manufactured from a flat stock.

7. The retractable container cover system of claim 1, wherein the cover comprises a plurality of interlocking slats, each slat pivotable relative to an adjacent slat.

8. The retractable container cover system of claim 1, wherein the cover comprises a coiling grille.

9. The retractable container cover system of claim 1, further comprising a drive mechanism coupled to the rotatable element.

10. The retractable container cover system of claim 1, further comprising a track assembly including a first track member and a second track member, the track assembly configured to slidably receive the cover.

11. The retractable container cover system of claim 10, wherein the cover moves within the track assembly in a substantially horizontal direction.

12. The retractable container cover system of claim 10, wherein the track assembly further comprises a friction-reducing element configured to reduce friction between the cover and at least one of the container, the first track member, and the second track member.

13. The retractable container cover system of claim 1, wherein the container comprises a plurality of sides, a bottom, and a cavity defined by the plurality of sides and the bottom, and wherein the cavity is substantially exposed when the cover is in the retracted position.

14. The retractable container cover system of claim 1, wherein the one or more slip linkages are in a first retracted position when the cover is in the retracted position and in a second extended position when the cover is in the deployed position.

15. The retractable container cover system of claim 1, wherein each of the one or more slip linkages comprise a prismatic joint.

16. The retractable container cover system of claim 1, wherein each of the one or more slip linkages comprises a first portion including a sliding element and a second portion including a corresponding slot to engage with the sliding element.

17. The retractable container cover system of claim 1, wherein the spiral guide comprises a channel in a side of the container.

* * * * *